US011284658B2

(12) United States Patent
Moore et al.

(10) Patent No.: US 11,284,658 B2
(45) Date of Patent: Mar. 29, 2022

(54) WATER SHORTS WITH WEBBED CONFIGURATION

(71) Applicant: HURLEY INTERNATIONAL LLC, Costa Mesa, CA (US)

(72) Inventors: Bruce Yin Moore, Laguna Beach, CA (US); Ryan Michael Hurley, Beaverton, OR (US); Carson William Wach, San Clemente, CA (US); Renata Hintze Marchand, Los Angeles, CA (US); Matthew Garrett Baker, Huntington Beach, CA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/085,650

(22) Filed: Mar. 30, 2016

(65) Prior Publication Data

US 2016/0206016 A1 Jul. 21, 2016

Related U.S. Application Data

(63) Continuation of application No. 13/178,779, filed on Jul. 8, 2011, now abandoned.

(51) Int. Cl.
*A41D 31/18* (2019.01)
*A41D 7/00* (2006.01)
(Continued)

(52) U.S. Cl.
CPC ..... *A41D 31/185* (2019.02); *A41D 1/06* (2013.01); *A41D 7/005* (2013.01); *A41F 9/00* (2013.01); *A41F 9/02* (2013.01); *A41D 2500/20* (2013.01)

(58) Field of Classification Search
CPC ..... A41D 1/06; A41D 1/08; A41D 2300/33; A41D 7/005; A41D 13/065; A41D 27/20;
(Continued)

(56) References Cited

U.S. PATENT DOCUMENTS 1,797,115 A 3/1931 Atkinson
1,831,451 A 11/1931 Jackson
(Continued)

FOREIGN PATENT DOCUMENTS

DE 20215559 U1 1/2003
EP 0082824 A2 6/1983
(Continued)

OTHER PUBLICATIONS

International Standard Reference No. ISO 13934-1:1999(E)—Textiles—Tensile Properties of Fabrics, 1st Edition, Feb. 15, 1999,18 pages.

(Continued)

*Primary Examiner* — Alissa J Tompkins
*Assistant Examiner* — Catherine M Ferreira
(74) *Attorney, Agent, or Firm* — Shook, Hardy & Bacon, L.L.P.

(57) ABSTRACT

An article of apparel, which may be a pair of water shorts, may include a stretch woven textile. More particularly, a pelvic region and a pair of leg regions may include the stretch woven textile element. A waistband region may also include the stretch woven textile elements, or may be formed from a variety of other material elements. In order to limit stretch in the waistband region, a variety of waistband elements may be utilized. For example, the waistband elements may be (a) a layered structure with a textile layer and a polymer layer, (b) a layered structure joined with stitching, (c) a layered structure joined with bonds, or (d) a layered structure formed from a folded material element. In order to limit stretch in the waistband region, a tensile component may be utilized.

10 Claims, 23 Drawing Sheets

(51) Int. Cl.
*A41D 1/06* (2006.01)
*A41F 9/00* (2006.01)
*A41F 9/02* (2006.01)

(58) Field of Classification Search
CPC ..... A41D 27/24; A41D 13/0015; A41D 1/14; A41D 1/20; A41D 1/22; A41D 2300/22; A41D 2400/38; A41D 2400/44; A41D 1/067; A41D 2300/32; A41D 2600/10; A41D 27/205; A41D 7/00; A41D 13/0017; A41D 31/02; A41F 9/00
USPC ..... 2/236, 237, 238, 69; 36/45; 428/198; 156/244
See application file for complete search history.

(56) References Cited

U.S. PATENT DOCUMENTS 2,034,091 A 3/1936 Dunbar
2,048,294 A 7/1936 Roberts
2,205,356 A 6/1940 Gruensfelder et al.
2,311,996 A 2/1943 Parker
2,573,773 A 11/1951 Rowe
2,854,669 A 10/1958 Cohen
3,169,558 A 2/1965 Aleixo et al.
3,357,076 A 12/1967 Greenwald et al.
3,439,434 A 4/1969 Tangorra
3,672,078 A 6/1972 Fukuoka
3,823,493 A 7/1974 Brehm et al.
3,842,437 A 10/1974 Campbell et al.
3,868,729 A 3/1975 Lynam
4,051,215 A 9/1977 Tsuruta et al.
4,345,908 A 8/1982 Mohr et al.
4,397,636 A 8/1983 Ganshaw et al.
4,523,337 A * 6/1985 Leibowitz ..... A41B 9/14 2/237
4,634,616 A 1/1987 Musante et al.
4,636,419 A * 1/1987 Stroucken ..... B04B 1/18 210/371
4,756,098 A 7/1988 Boggia
4,858,339 A * 8/1989 Hayafuchi ..... A43B 1/04 36/114
4,873,725 A 10/1989 Mitchell
5,149,388 A 9/1992 Stahl et al.
5,156,022 A 10/1992 Altman et al.
5,161,257 A 11/1992 Arensdorf et al.
5,271,130 A 12/1993 Batra
5,285,658 A 2/1994 Altman et al.
5,309,376 A 5/1994 Barraco et al.
5,345,638 A 9/1994 Nishida
5,359,790 A 11/1994 Iverson et al.
5,367,795 A 11/1994 Iverson et al.
5,390,376 A 2/1995 Marx et al.
5,399,410 A 3/1995 Urase et al.
5,487,710 A 1/1996 Lavorgna et al.
5,645,924 A 7/1997 Hamilton
5,737,773 A 4/1998 Dicker et al.
5,768,703 A 6/1998 Machado et al.
5,832,540 A 11/1998 Knight
D405,587 S 2/1999 Merikoski
5,930,918 A 8/1999 Healy et al.
5,987,721 A 11/1999 Morris
5,990,378 A 11/1999 Ellis
6,003,247 A 12/1999 Steffe
6,004,891 A * 12/1999 Tuppin ..... A41D 31/0061 139/408
6,009,637 A 1/2000 Pavone
6,029,376 A 2/2000 Cass
6,038,702 A 3/2000 Knerr
6,124,001 A 9/2000 Sugita et al.
6,128,835 A 10/2000 Ritter et al.
6,151,804 A 11/2000 Hieblinger
6,164,228 A 12/2000 Lin et al.
6,170,175 B1 1/2001 Funk
6,199,215 B1 3/2001 Biggerstaff
6,213,634 B1 4/2001 Harrington
6,243,879 B1 6/2001 Lyden
6,401,250 B1 6/2002 McNabb
6,615,427 B1 9/2003 Hailey
6,647,550 B1 11/2003 Matsuzaki et al.
6,665,958 B2 12/2003 Goodwin
6,692,606 B1 * 2/2004 Cederblad ..... B29D 28/00 156/166
6,718,895 B1 4/2004 Fortuna
6,817,031 B1 11/2004 Gravlin
6,860,214 B1 3/2005 Wang
6,878,433 B2 * 4/2005 Curro ..... B32B 37/144 428/156
6,910,288 B2 6/2005 Dua
7,086,179 B2 8/2006 Dojan et al.
7,086,180 B2 8/2006 Dojan et al.
7,100,310 B2 9/2006 Foxen et al.
7,293,371 B2 11/2007 Aveni
7,337,560 B2 3/2008 Marvin et al.
7,849,518 B2 12/2010 Moore et al.
7,870,681 B2 1/2011 Meschter
7,870,682 B2 1/2011 Meschter et al.
7,941,871 B1 * 5/2011 Jorgensen ..... A41D 7/005 2/228
2003/0178738 A1 9/2003 Staub et al.
2003/0208829 A1 11/2003 Ragot
2003/0233698 A1 12/2003 Villalobos
2004/0074589 A1 4/2004 Gessler et al.
2004/0098784 A1 * 5/2004 Desai ..... A41B 9/00 2/69
2004/0142631 A1 7/2004 Luk
2004/0181972 A1 9/2004 Csorba
2004/0261295 A1 12/2004 Meschter
2005/0028403 A1 2/2005 Swigart
2005/0115284 A1 6/2005 Dua
2005/0132609 A1 6/2005 Dojan et al.
2005/0165200 A1 7/2005 Selle et al.
2005/0223753 A1 10/2005 Nordstrom
2005/0268497 A1 12/2005 Alfaro et al.
2006/0048413 A1 3/2006 Sokolowski et al.
2006/0137221 A1 6/2006 Dojan et al.
2006/0270294 A1 11/2006 Hamano et al.
2007/0101481 A1 5/2007 Stokesbary
2007/0199210 A1 * 8/2007 Vattes ..... A43B 13/12 36/45
2007/0271821 A1 11/2007 Meschter
2008/0110049 A1 5/2008 Sokolowski et al.
2008/0256675 A1 10/2008 Di Lorenzo
2009/0038046 A1 * 2/2009 Moore ..... A41D 1/08 2/67
2010/0018075 A1 1/2010 Meschter et al.
2010/0037483 A1 2/2010 Meschter et al.
2010/0043253 A1 2/2010 Dojan et al.
2010/0154256 A1 6/2010 Dua
2010/0175276 A1 7/2010 Dojan et al.
2010/0199406 A1 8/2010 Dua et al.
2010/0251491 A1 10/2010 Dojan et al.
2010/0251564 A1 10/2010 Meschter
2010/0275344 A1 11/2010 Demarest et al.
2011/0041359 A1 2/2011 Dojan et al.
2011/0072558 A1 3/2011 Berns
2015/0004860 A1 * 1/2015 Harashige ..... B32B 27/36 442/5
2015/0152578 A1 * 6/2015 Darby ..... D04B 1/104 66/171
2016/0059516 A1 * 3/2016 Harris ..... B32B 7/12 442/1

FOREIGN PATENT DOCUMENTS

EP 0818289 A2 1/1998
EP 1627574 A1 2/2006
EP 2206441 A1 7/2010
FR 1462349 12/1966
FR 2457651 A1 12/1980
FR 2742171 A1 6/1997
GB 766834 1/1957

(56) References Cited

FOREIGN PATENT DOCUMENTS

| | | | |
|---|---|---|---|
| GB | 1111116 | | 4/1968 |
| JP | 48-3618 | | 1/1973 |
| JP | 7-9925 | U | 2/1995 |
| WO | 9843506 | A1 | 10/1998 |
| WO | 03013301 | A1 | 2/2003 |
| WO | 2004009705 | A1 | 1/2004 |
| WO | 2012/021528 | A2 | 2/2012 |

OTHER PUBLICATIONS

Wu, Jianhua et al., "Grab and Strip Tensile Strengths for Woven Fabrics: An Experimental Verification", Textile Research Journal, vol. 75, Nov. 2006, pp. 789-796.
Textiles Testing Solutions, URL: http://www.instron.us/wa/solutions/solutions_by_element.aspx?ParentID=86, 5 pages.
Final Office Action dated Jan. 26, 2017 in U.S. Appl. No. 13/178,779, 15 pages.

* cited by examiner

WATER SHORTS WITH WEBBED CONFIGURATION

CROSS-REFERENCE TO RELATED APPLICATIONS

This application is a continuation of pending U.S. patent application Ser. No. 13/178,779, filed Jul. 8, 2011, and titled "Water Shorts," the contents of which are incorporated herein by reference in their entirety.

BACKGROUND

Water shorts are commonly worn when engaging in various aquatic activities, such as surfing and recreational swimming. Common styles of water shorts are swim trunks and board shorts. When worn, water shorts cover a pelvic area, and upper leg areas of an individual. Although water shorts have a generally loose-fitting configuration, water shorts are relatively tight around the waist to ensure that the water shorts remain properly positioned on the individual during the aquatic activities.

SUMMARY

An article of apparel, which may be a pair of water shorts, is disclosed below. A portion of the apparel may be formed, for example, from a stretch woven textile element. More particularly, a pelvic region and a pair of leg regions may include the stretch woven textile element. A waistband region may also include the stretch woven textile elements, or may be formed from a variety of other material elements. In order to limit stretch in the waistband region, a variety of waistband elements may be utilized. For example, the waistband elements may be (a) a layered structure with a textile layer and a polymer layer, (b) a layered structure joined with stitching, (c) a layered structure joined with bonds, or (d) a layered structure formed from a folded material element. In order to limit stretch in the waistband region, a tensile component may be utilized.

The advantages and features of novelty characterizing aspects of the invention are pointed out with particularity in the appended claims. To gain an improved understanding of the advantages and features of novelty, however, reference may be made to the following descriptive matter and accompanying drawings that describe and illustrate various embodiments and concepts related to the invention.

FIGURE DESCRIPTIONS

The foregoing Summary of the Invention and the following Detailed Description of the Invention will be better understood when read in conjunction with the accompanying drawings.

DETAILED DESCRIPTION

The following discussion and accompanying figures disclose an article of apparel 100 having a configuration of a pair of water shorts (e.g., swim trunks, board shorts) that is suitable for use during a variety of aquatic activities, such as swimming, surfing, water skiing, snorkeling, and scuba diving. In further configurations, apparel 100 may have the structure of other types of shorts that are utilized during athletic activities, including basketball shorts, biking shorts, running shorts, and soccer shorts, for example. Concepts associated with apparel 100 may also be applied to similar garments, including dress shorts, jeans, pants, skirts, slacks, tights, or various types of undergarments. In addition to water shorts, therefore, the concepts associated with apparel 100 may be applied to a wide range of garment styles or configurations that are used for aquatic, land-based, athletic, and non-athletic activities.

General Apparel Structure

Figure 1:
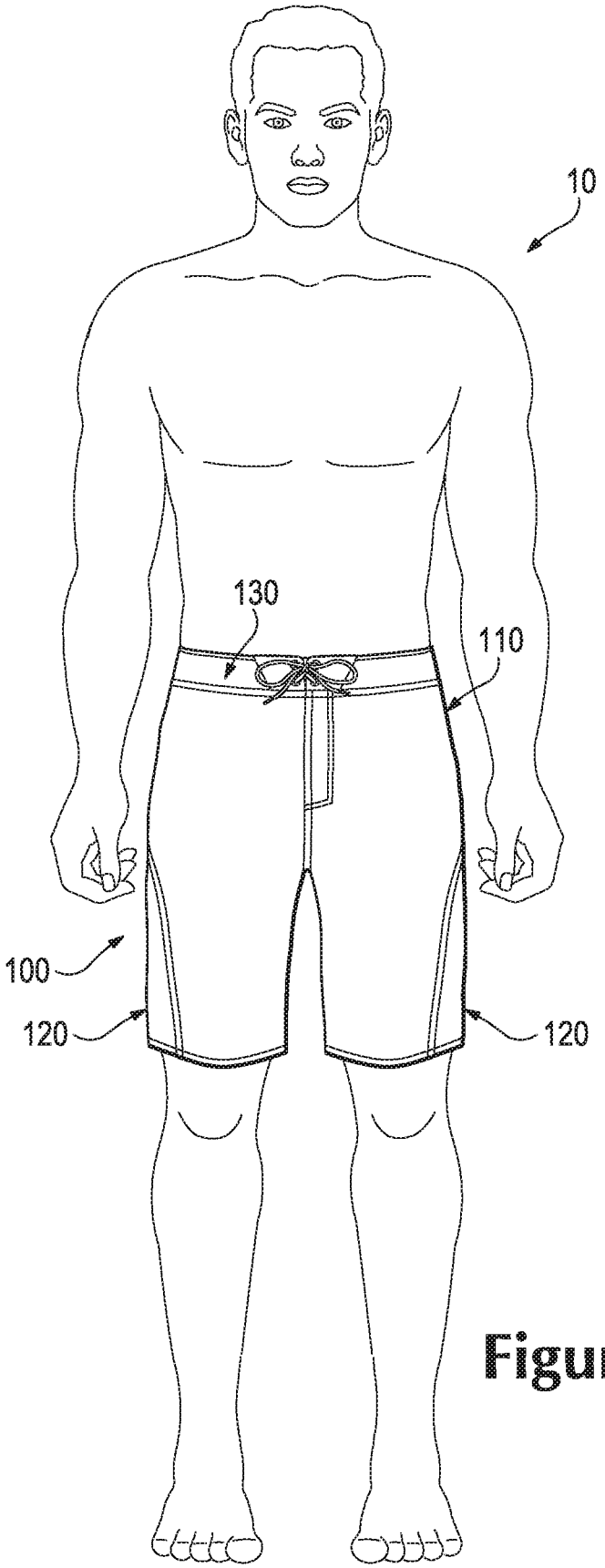
FIG. 1 is a front elevational view of an individual wearing an article of apparel.
Figure 2:
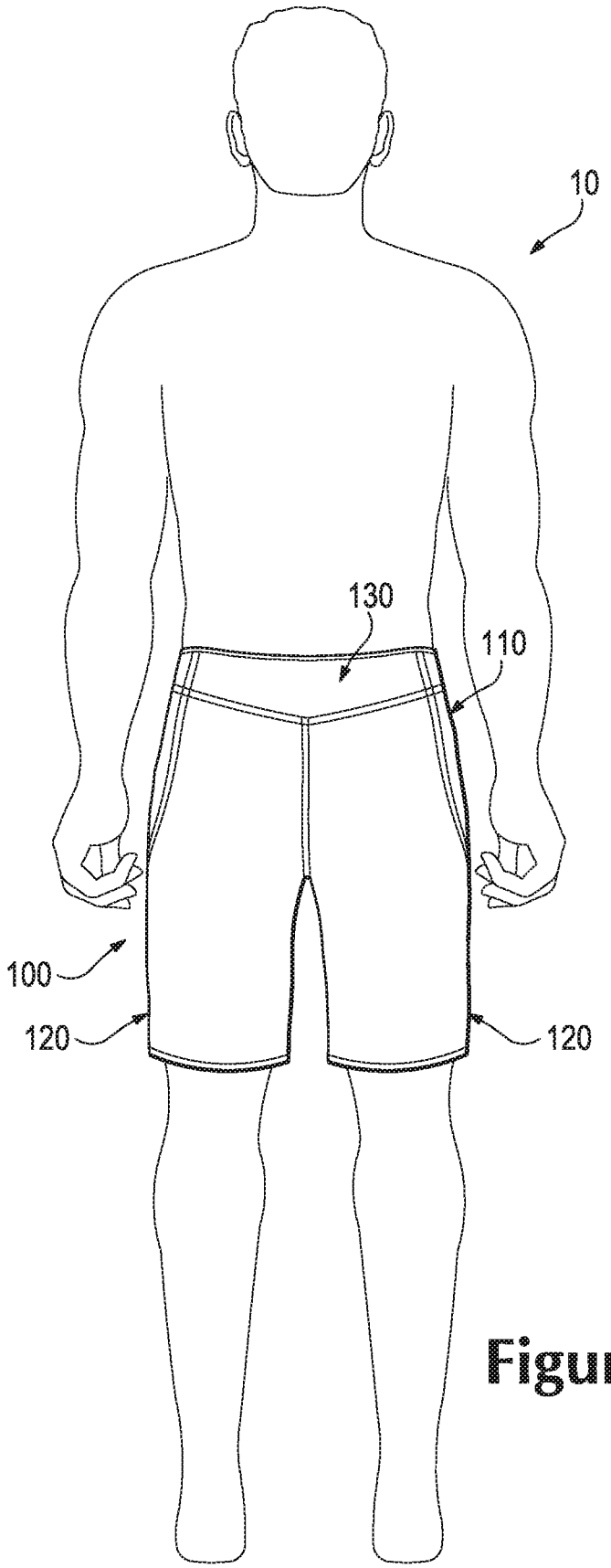
FIG. 2 is a rear elevational view of the individual wearing the article of apparel.
Figure 3:
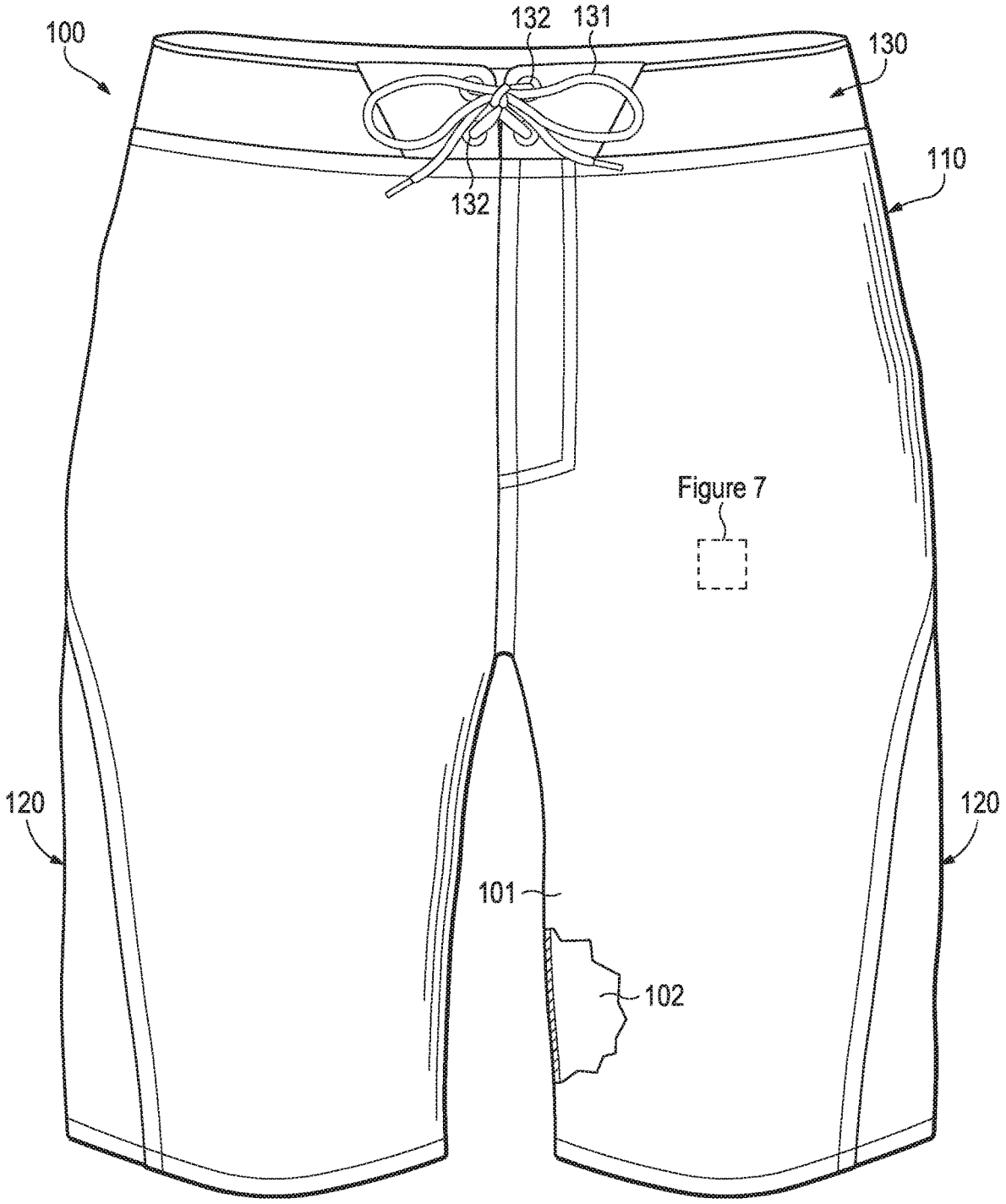
FIG. 3 is a front elevational view of the article of apparel.
Figure 4:
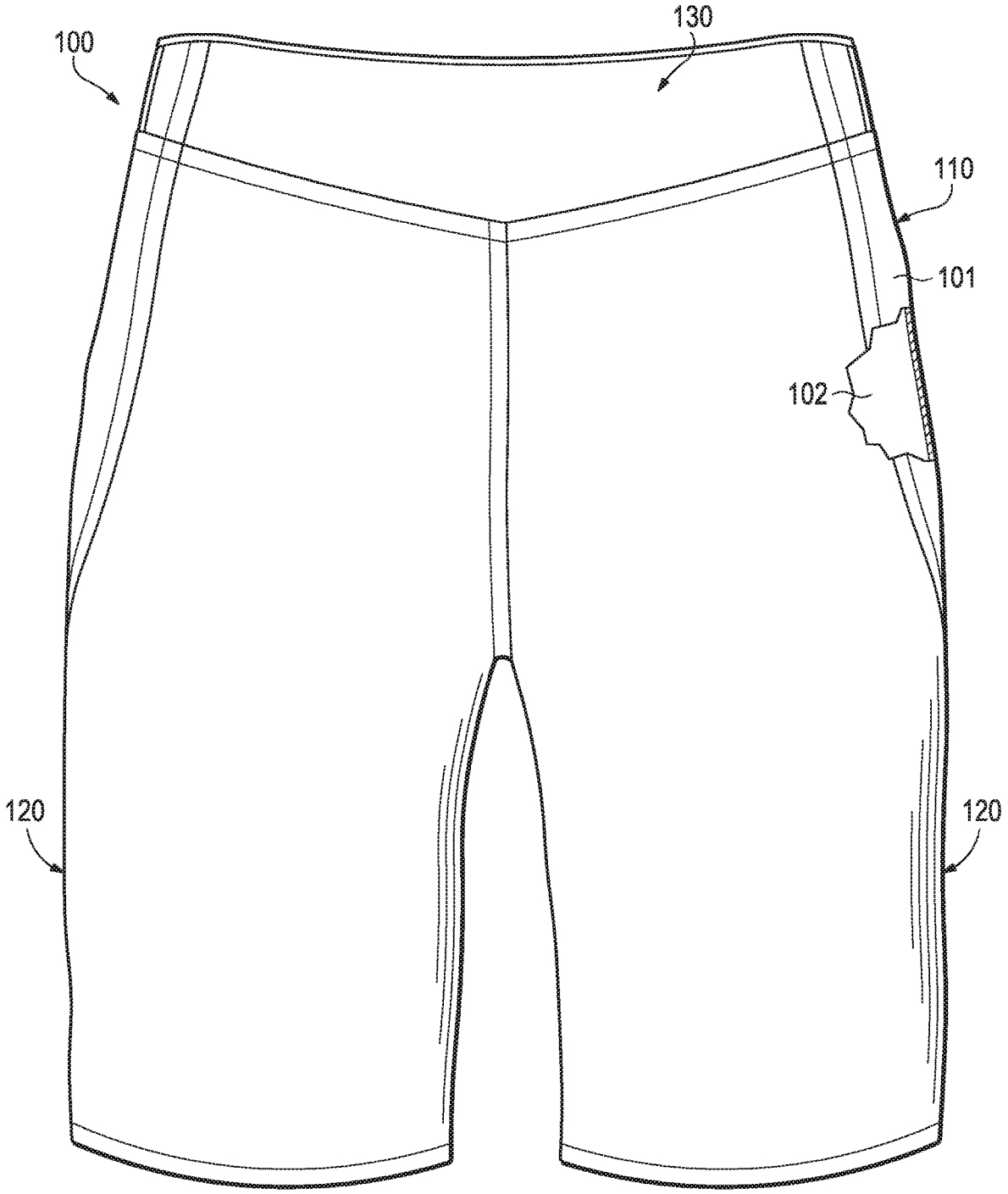
FIG. 4 is a rear elevational view of the article of apparel.
Figure 5:
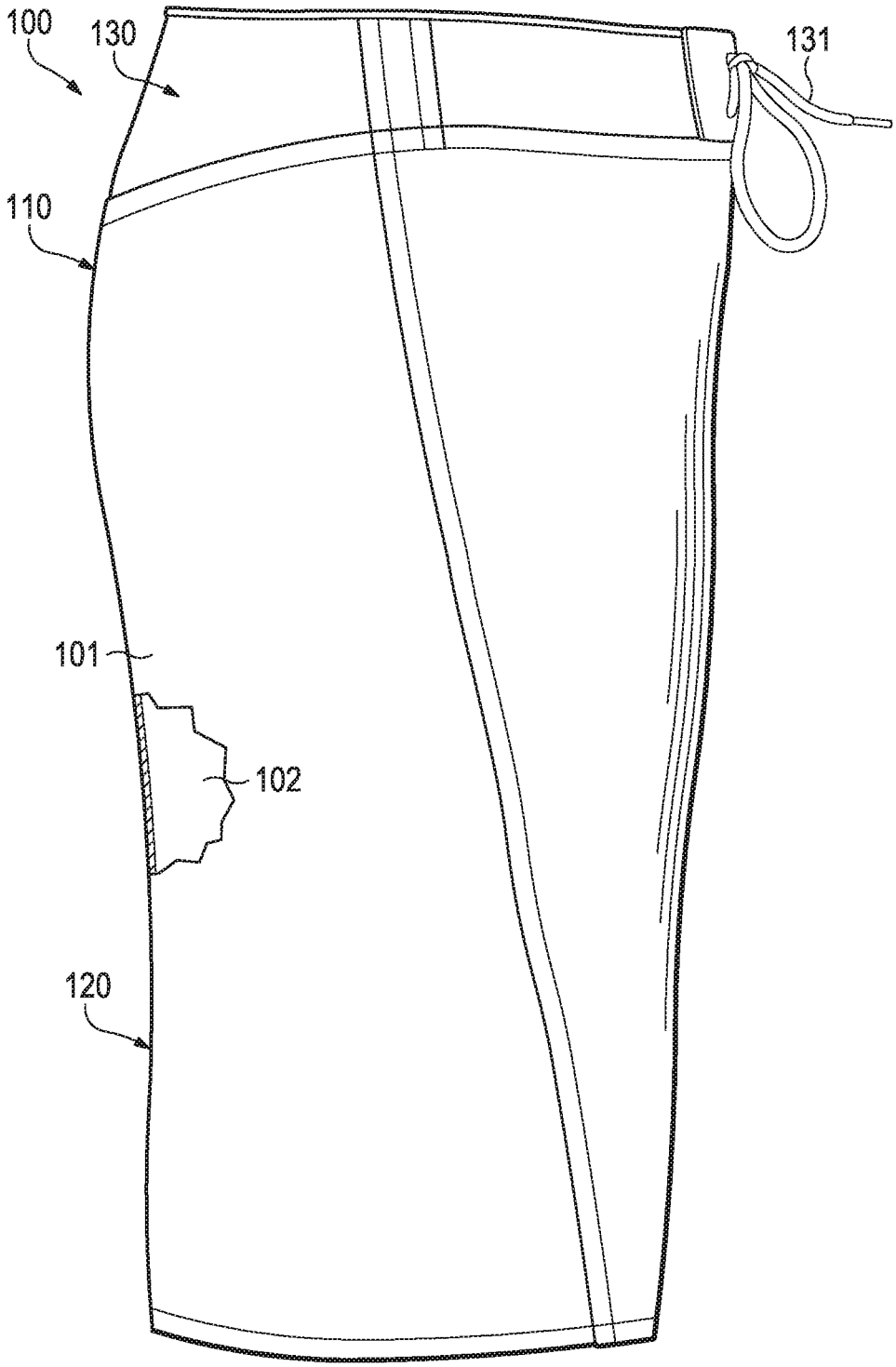
FIGS. 5 and 6 are side elevational views of the article of apparel.
Figure 6:
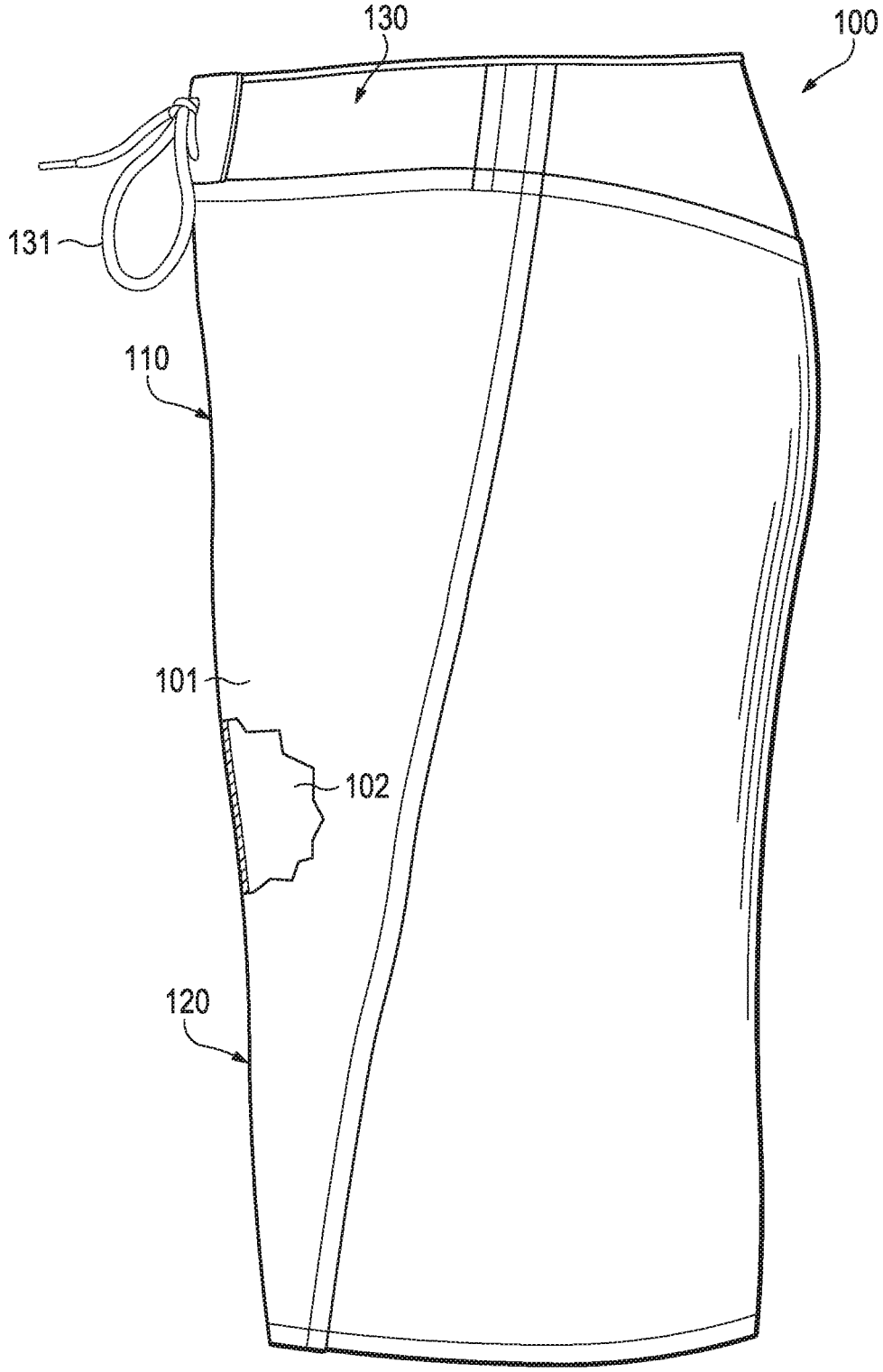

With reference to FIGS. 1 and 2, apparel 100 is depicted as being worn by an individual 10. Additionally, various views of apparel 100 in the absence of individual 10 or another wearer are provided in FIGS. 3-6. Apparel 100 includes a pelvic region 110, a pair of leg regions 120, and a waistband region 130. Pelvic region 110 covers a pelvic area of individual 10. Leg regions 120 extend downward or otherwise outward from opposite sides of pelvic region 110 and substantially extend around and cover upper leg areas of individual 10. Waistband region 130 is located at and joined with an upper area of pelvic region 110, which is opposite leg regions 120, and extends around a waist of individual 10. Additionally, apparel 100 has an exterior surface 101 and an opposite interior surface 102. Whereas exterior surface 101 faces away from individual 10 when apparel 100 is worn, interior surface 102 faces toward individual 10 and may contact individual 10.

Apparel 100 is generally structured to be spaced from individual 10 or in loose contact with individual 10 when worn, thereby having a loose-fitting configuration. More particularly, pelvic region 110 and leg regions 120 generally have the loose-fitting configuration. Waistband region 130, however, has a tight-fitting configuration. That is, waistband region 130 lays against the waist of individual 10 around substantially all of the waist. A lace 131 extends through various apertures 132 in a front area of waistband region 130, and lace 131 crosses between apertures 132. When apparel 100 is worn by individual 10, lace 131 may be utilized in a conventional manner to adjust the circumference of waistband region 130, thereby tightening and loosening waistband region 130. That is, lace 131 may be tensioned and tied to secure apparel 100 to individual 10, and lace 131 may be untied and loosened to assist in removing apparel 100 from individual 10. Although the combination of lace 131 and apertures 132 provides a suitable structure for adjusting the circumference of waistband region 130, other fasteners that may be utilized in further configurations of apparel 100 include zippers, snaps, buttons, and hook-and-loop fasteners.

A majority of apparel 100 is formed from various textile elements that are joined at seams through stitching, adhesive bonding, or thermal bonding, for example. Depending upon materials utilized for the textile elements and other factors, a variety of stitch types and seams may be utilized, including triple coverstitch seams, other coverstitch seams, overlock stitch seams, flatlock stitch seams, zigzag stitch seams, single needle lock stitch seams, double needle lock stitch seams, triple needle lock stitch seams, and bartack, although other seam or stitch types may be utilized. The textile elements may be formed from either stretch textiles or non-stretch textiles. Although non-stretch textile elements may be utilized in apparel 100, an advantage to stretch textile elements is that portions of regions 110 and 120 will stretch or otherwise elongate to conform with movements of individual 10 during aquatic or land-based activities, thereby providing less restriction and a greater freedom of movement during the activities. The textile elements may also be formed from either woven or knitted textiles. Although knitted textile elements may be utilized in apparel 100, an advantage of utilizing woven textile elements relates to high durability and a low tendency to permanently deform when subjected to tensile forces (i.e., when stretched). A further advantage to woven textile elements, which benefits apparel 100 having the configuration of water shorts, is that small spaces between yarns within the woven textile elements tend to hold a small quantity of water and exhibit little deformation as a result of being saturated with water. Moreover, the textile elements may be formed from yarns that include a wide range of materials, including acrylic, cotton, elastane (or spandex), nylon, polyamide, polyester, silk, wool, or combinations of these materials, for example. In addition to textile elements, portions of apparel 100 may also include various appliqués, transfers, patches, indicia, tags, pulls, grommets, or other aesthetic or functional features.

Figure 7:
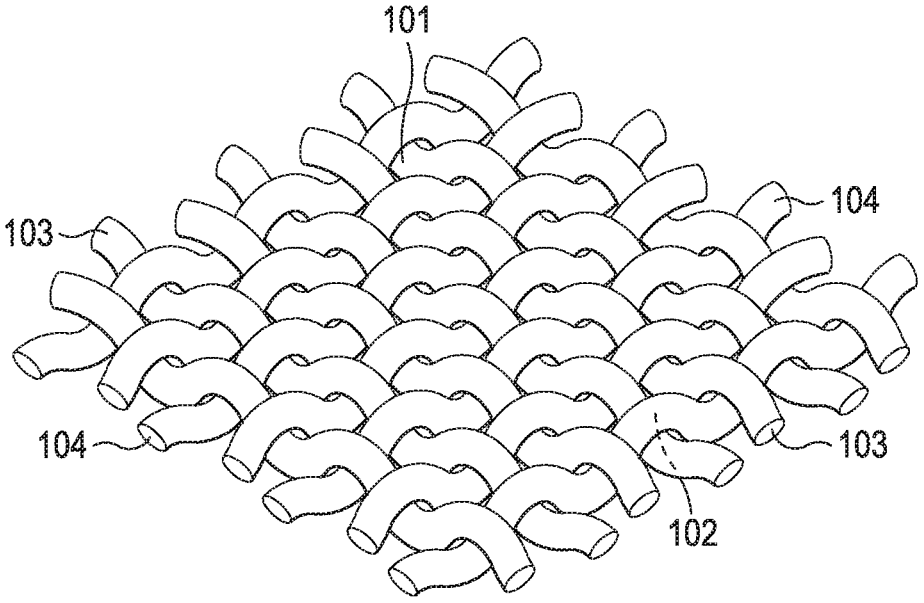
FIG. 7 is a perspective view of a portion of a textile element from the article of apparel, as defined in FIG. 3.

As noted above, the textile elements forming apparel 100 may include stretch textile elements and woven textile elements. Combining these features, the textile elements forming apparel 100 may include stretch woven textile elements. That is, the textile elements in apparel 100 may be formed to exhibit a woven structure that stretches upon the application of a tensile force. An example of a portion of a stretch woven textile element is depicted in FIG. 7 as having a plurality of warp yarns 103 and weft yarns 104 that weave together at substantially right angles. Note that opposite surfaces of the stretch woven textile element in FIG. 7 form both exterior surface 101 and interior surface 102. Moreover, a suitable stretch woven textile may gain stretch through the use of elastane in one or both of yarns 103 and 104 or compressing one or both of yarns 103 and 104 during a weaving process. As an example, a stretch woven textile may be formed from 85% polyester (e.g., polyethylene terephthalate) and 15% elastane with a weight of approximately 162 grams per square meter. As another example, a stretch woven textile may be formed from 80% nylon and 20% elastane. In either of these examples, the polyester or nylon may also be formed from recycled materials.

Various properties of the stretch woven textile elements may affect the stretch in apparel 100. In some configurations, warp yarns 103 may be formed from a stretch material and weft yarns 104 may be formed from a non-stretch material, for example, to impart two-directional stretch in the textile elements. In another configuration, both of yarns 103 and 104 may be formed from stretch materials to impart four-directional stretch in the textile elements. Moreover, the weave density of yarns 103 and 104, the specific materials forming yarns 103 and 104, and the configuration of yarns 103 and 104 (e.g., twist, crimp, denier) may impart different degrees of stretch in apparel 100. A general test method for measuring stretch may include determining an amount of elongation of a textile element for a given tensile force. In this test method, lesser elongation corresponds with less stretch, and greater elongation corresponds with more stretch. Another test method for measuring stretch in textile elements is ASTM D5035-11, which was issued by ASTM International and entitled Standard Test Method For Breaking Force And Elongation Of Textile Fabrics (Strip Method), although various other test methods may be utilized. Utilizing a similar test method, the stretch woven textile elements in apparel 100 will generally stretch in a range of 20 percent to 200 percent or more, although a range of 40 percent to 160 percent is also possible. Specifically, the degree of stretch in the stretch woven textile elements in apparel 100 may be 40 percent, 50, percent, 60 percent, 70 percent, or 110 percent, as examples.

Many or all of the textile elements forming apparel 100 may exhibit stretch, thereby imparting the various advantages discussed above. In some configurations, the stretch woven textile elements may form a majority of the material elements in apparel 100. As an example, substantially all of the textile elements forming each of pelvic region 110 and leg regions 120 may be the stretch woven textile elements, although waistband region 130 may include a variety of other materials. As another example, pelvic region 110 and leg regions 120 may be formed from both stretch and non-stretch woven textile elements. In many configurations, however, a majority of exterior surface 101 and interior surface 102 in each of pelvic region 110 and leg regions 120 are formed from the stretch woven textile elements to ensure that the various advantages discussed above are present in apparel 100. In other configurations, a majority of exterior surface 101 and interior surface 102 in one of pelvic region 110 and leg regions 120 is formed from the stretch woven textile elements. As such, even when various appliques are added to exterior surface 101 or a liner is utilized within pelvic region 110, a majority of surfaces 101 and 102 may be formed from the stretch woven textile elements. Notably, however, lesser amounts of stretch woven textile may be used in some configurations of apparel 100.

Although many or all of the textile elements forming apparel 100 may exhibit stretch (e.g., may be stretch woven textile elements), waistband region 130 may have less stretch or may be non-stretch. An advantage of limiting stretch in waistband region 130 relates to securing apparel 100 to individual 10. During many aquatic activities, water moving relative to individual 10 may tend to pull apparel 100 in various directions. Moreover, the water may tend to pull apparel 100 in a direction that would remove apparel 100 from individual 10. Limiting stretch in waistband region 130, however, permits fastening of apparel 100 to individual 10 in a secure manner. As such, forming waistband region 130 to have limited stretch ensures that water shorts 100 remain properly positioned on individual 10 during aquatic activities.

One manner of limiting stretch in waistband region 130 is to utilize non-stretch materials or materials with relatively little stretch. As an example, U.S. Pat. No. 7,849,518 to Moore, et al., which is incorporated herein by reference, discloses water shorts formed from (a) a stretch woven textile in pelvic and leg regions and (b) a non-stretch textile in a waistband. Various other structures, which are discussed below, may also be utilized to limit stretch in waistband region 130. Moreover, these structures may incorporate stretch woven textiles, non-stretch woven textiles, and a variety of other materials.

First Waistband Configuration

Figure 8:
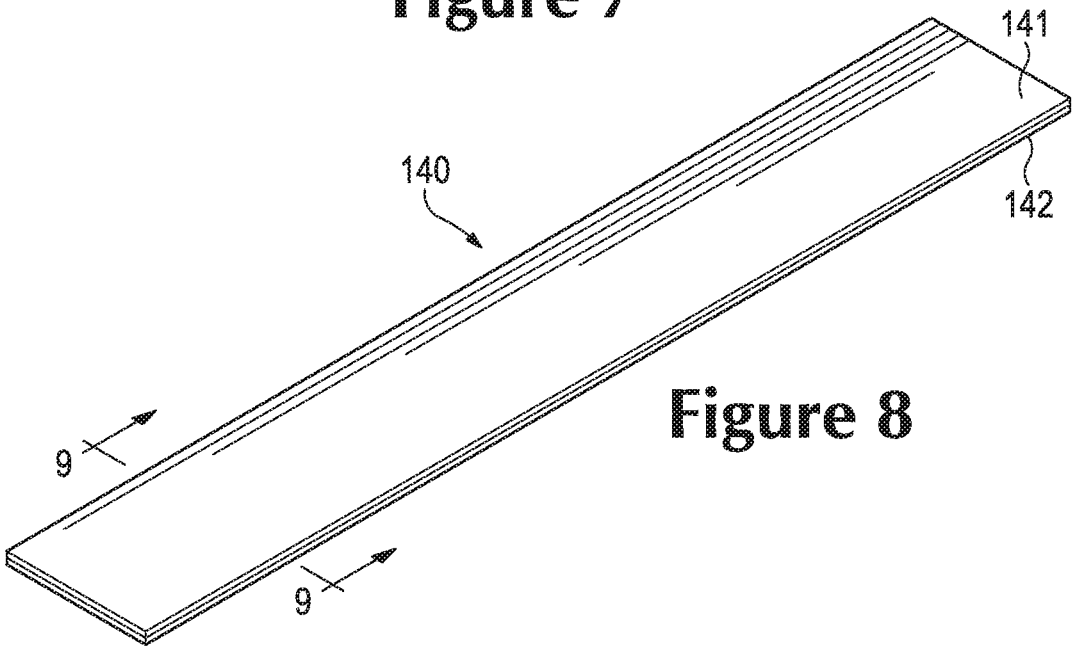
FIG. 8 is a perspective view of a first waistband element that may form a portion of a waistband of the article of apparel.
Figure 9:
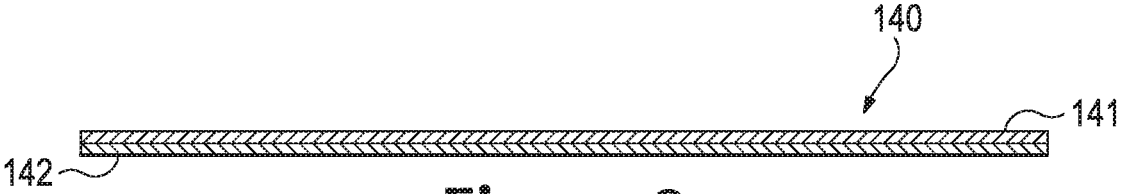
FIG. 9 is a cross-sectional view of the first waistband element, as defined by section line 9 in FIG. 8.

A waistband element 140 that may be utilized in waistband region 130 is depicted in FIGS. 8 and 9. More particularly, waistband element 140 is depicted as having a configuration that may form a portion of a front area of waistband region 130. In other configurations, waistband element 140 may extend around substantially all of waistband region 130, or waistband element 140 may extend to a rear area of waistband region 130.

The primary components of waistband element 140 are a first layer 141 and a second layer 142 that lay adjacent to each other. Whereas first layer 141 is a textile (e.g., stretch woven textile, non-stretch woven textile, knitted textile, non-woven textile, mesh textile), second layer 142 is a polymer sheet or element that is bonded or otherwise secured to first layer 141 through adhesive bonding or thermal bonding. As another example, second layer 142 may be a non-woven material with thermoplastic polymer filaments, such as the thermoplastic non-woven material disclosed in U.S. Patent Application Publication 2010/0199406 to Dua, et al. In some configurations, stitching or other securing elements may be utilized to supplement the bond between layers 141 and 142.

The polymer material of second layer 142 may be a thermoplastic polymer material, such as thermoplastic polyurethane. Thermoplastic polymer materials exhibit the property of melting when heated and returning to a solid state when cooled sufficiently. Based upon this property of thermoplastic polymer materials, thermal bonding processes may be utilized to form a thermal bond that joins layers 141 and 142. As utilized herein, the term "thermal bonding" or variants thereof is defined as a securing technique between two elements that involves a softening or melting of a thermoplastic polymer material within at least one of the elements such that the materials of the elements are secured to each other when cooled. Similarly, the term "thermal bond" or variants thereof is defined as the bond, link, or structure that joins two elements through a process that involves a softening or melting of a thermoplastic polymer material within at least one of the elements such that the materials of the elements are secured to each other when cooled. As examples, thermal bonding may involve (a) the melting or softening of second layer 142 such that the thermoplastic polymer material of second layer 142 intermingles with materials of first layer 141 to secure layers 141 and 142 together when cooled and (b) the melting or softening of second layer 142 such that the thermoplastic polymer material of second layer 142 extends into or infiltrates the structure of first layer 141 (e.g., extends around or bonds with filaments or fibers in yarns 103 and 102) to secure layers 141 and 142 together when cooled. In general, a thermal bonding process may involve (a) placing layers 141 and 142 adjacent to each other and (b) compressing layers 141 and 142 between platens of a heated press. Upon removal from the press and cooling, layers 141 and 142 are effectively joined. Additionally, thermal bonding does not generally involve the use of stitching or adhesives, but involves directly bonding elements to each other with heat. In some situations, however, stitching or adhesives may be utilized to supplement the thermal bond or the joining of layers 141 and 142 through thermal bonding.

The various textiles that may form first layer 141 exhibit a wide range of stretch upon the application of a tensile force. Moreover, some of the textiles (e.g., the stretch woven textile) may exhibit notable stretch. The combination of first layer 141 and second layer 142, however, exhibits less stretch than first layer 141 alone. As discussed above, thermal bonding may include the melting or softening of second layer 142 such that the thermoplastic polymer material of second layer 142 extends around or bonds with filaments or fibers in yarns 103 and 102. As such, the thermoplastic polymer material of second layer 142 may restrict the movement or stretch in yarns 103 and 104, thereby limiting the overall stretch in waistband element 140. Accordingly, the combination of layers 141 and 142 (i.e., waistband element 140) may be incorporated into apparel 100 to impart limited stretch to waistband region 130.

Although various textiles may form first layer 141, some configurations incorporate a stretch woven textile, which may also form portions of both pelvic region 110 and leg regions 120. When incorporated into apparel 100, first layer 141 may be oriented to face outwards and form a portion of exterior surface 101 of apparel 100. An advantage of this orientation relates to the aesthetics of apparel 100. More particularly, the exterior of waistband region 130 is formed from the same material as the exterior of pelvic region 110 and leg regions 120, thereby imparting a uniform appearance throughout apparel 100.

Figure 10A:
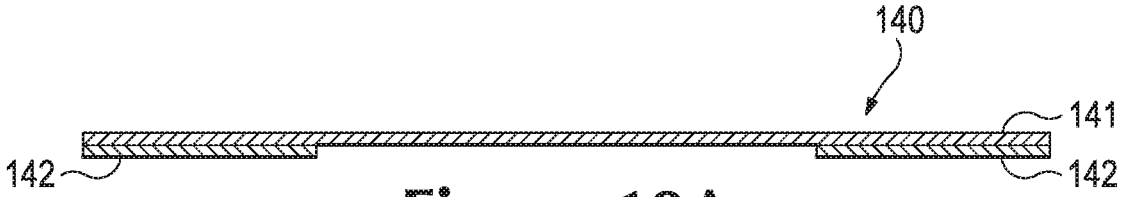
FIGS. 10A-10F are cross-sectional views corresponding with FIG. 9 and depicting further configurations of the first waistband element.
Figure 10B:
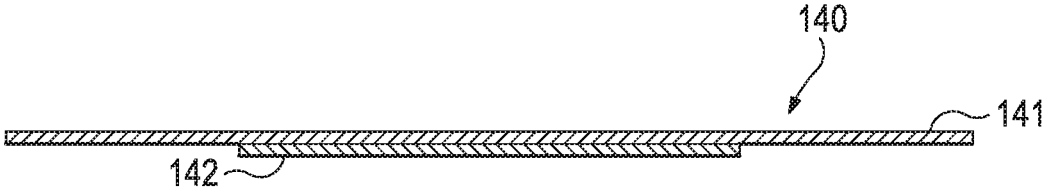

The configuration of waistband element 140 discussed above provides an example of the manner in which a layered configuration may be utilized to impart limited stretch to waistband region 130. A variety of other configurations may also be utilized. As an example, FIG. 10A depicts a configuration where second layer 142 is located adjacent edge areas of first layer 141, but is absent from a central area of first layer 141. Similarly, FIG. 10B depicts a configuration where second layer 142 is located in the central area of first layer 141, but is absent from the edge areas of first layer 141. In both of these configurations, the extent to which second layer 142 is bonded across the width of first layer 141 may be utilized to modify the stretch properties of waistband element 140. That is, waistband element 140 may exhibit lesser stretch when second layer is bonded to a relatively small portion of first layer 141, and waistband element 140 may exhibit greater stretch when second layer is bonded to a larger portion of first layer 141.

Figure 10C:
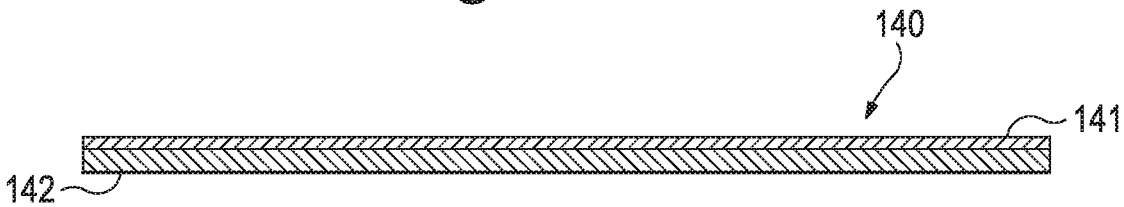
Figure 10D:
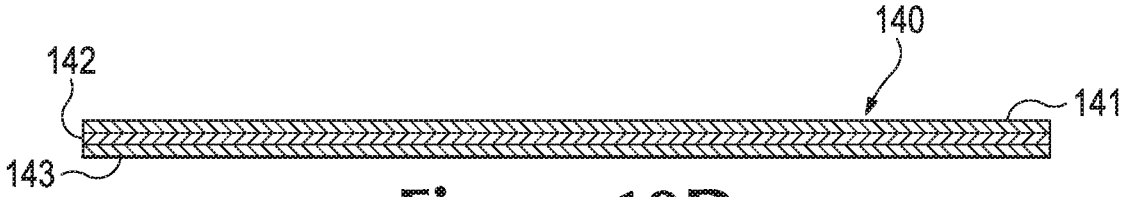
Figure 10E:
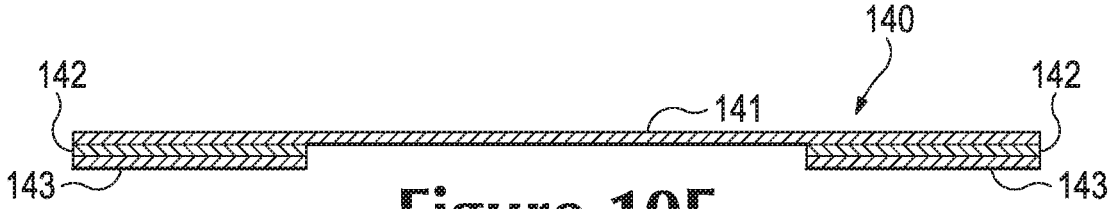
Figure 10F:
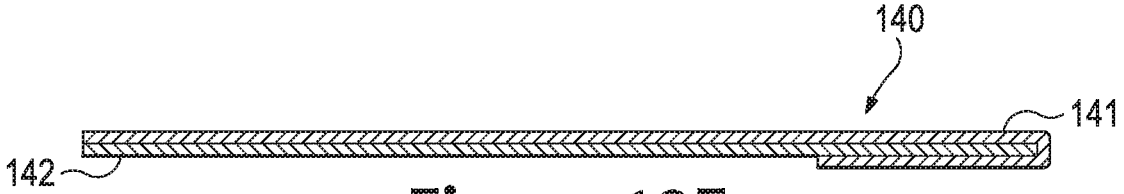

Continuing with further configurations of waistband element 140, FIG. 10C depicts second layer 142 as having greater thickness than first layer 141, which may further reduce the stretch in waistband element 140. In another configuration depicted in FIG. 10D, a third layer 143 may be secured (e.g., adhesive or thermal bonded) to first layer 141 with second layer 142. Third layer 143 may be a stretch woven textile, non-stretch woven textile, knitted textile, non-woven textile, mesh textile, polymer sheet, natural or synthetic leather, or variety of other materials that impart further stretch reduction or other properties to waistband element 140. A configuration that combines the concepts of FIGS. 10A and 10D is depicted in FIG. 10E, wherein two separate portions of layers 142 and 143 are located adjacent edge areas of first layer 141, but are absent from a central area of first layer 141, and the two portions of third layer 143 may be secured (e.g., adhesive or thermal bonded) to first layer 141 with the two portions of second layer 142. Referring to FIG. 10F, first layer 141 may also wrap around an edge of second layer 142, which may impart a more finished or aesthetically-appealing appearance to waistband region 130. It should be noted that any of the configurations discussed above may be utilized in combination. For example, the manner in which first layer 141 wraps in FIG. 10F may be applied to any of the configurations in FIGS. 8 and 10A-10E. As another example, the three layer structures of FIGS. 10D and 10E may be applied to other configurations.

Figure 28:
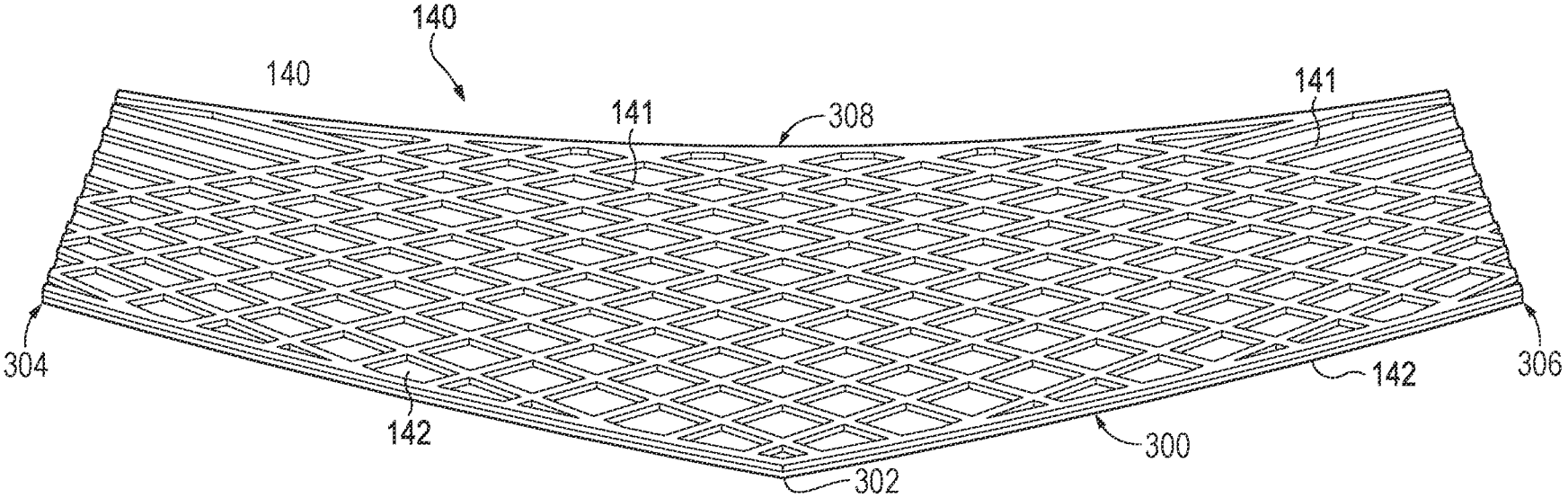
FIG. 28 is a perspective view of a further configuration of the first waistband element.

Another example of waistband element 140 is depicted in FIG. 28 as having a configuration that may form a portion of a rear area of waistband region 130. Whereas first layer 141 has a continuous configuration, second layer 142 has a web-like configuration that forms a plurality of apertures. That is, second layer 142 covers less area than first layer 141 and exposes areas of first layer 141 through the apertures. Whereas first layer 141 may be a textile, second layer 142 may be a polymer sheet or element that is bonded or otherwise secured to first layer 141 through adhesive bonding or thermal bonding. As an alternative, a configuration similar to FIG. 10E may be utilized, wherein another layer with a web-like configuration is utilized. Accordingly, a variety of layered configurations may be utilized in waistband element 140 to impart limited stretch to waistband region 130. The waistband element 140 may include a continuous bottom perimeter edge 300 and a continuous top perimeter edge 308. The continuous bottom perimeter edge 300 may include a midpoint 302. In some aspects, the midpoint 302 may be centered on a back of the waistband region 130 of the apparel 100. For example, the waistband element 140 may be positioned on the apparel 100 such that it substantially follows the contours of the waistband region 130, such as that shown in FIG. 2. Further, the continuous bottom perimeter edge 300 may extend from a first end 304 to a second end 306, as seen in FIG. 28. In aspects, the continuous bottom perimeter edge 300 may diverge from the continuous top perimeter edge 308 from the first end 304 to the midpoint 302 and may converge towards the continuous top perimeter edge 308 from the midpoint 302 to the second end 306. In the aspect shown in FIG. 28, the continuous bottom perimeter edge only transitions from diverging to converging at the midpoint 302.

Second Waistband Configuration

Figure 11:
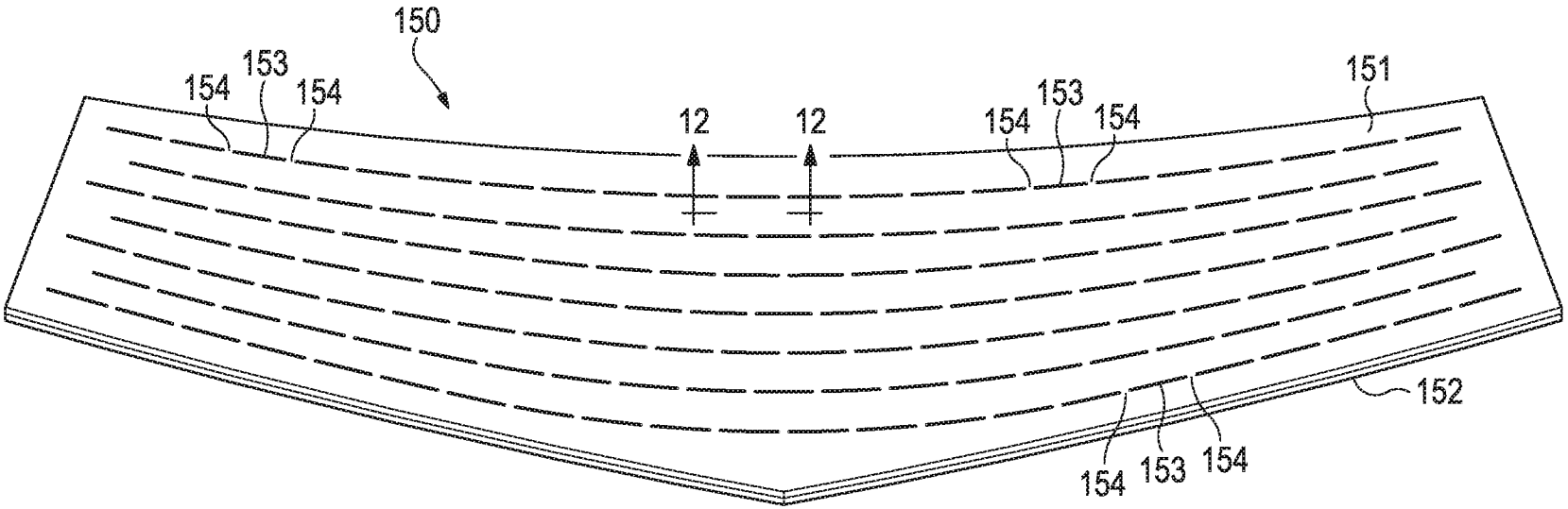
FIG. 11 is a perspective view of a second waistband element that may form a portion of the waistband.
Figure 12:
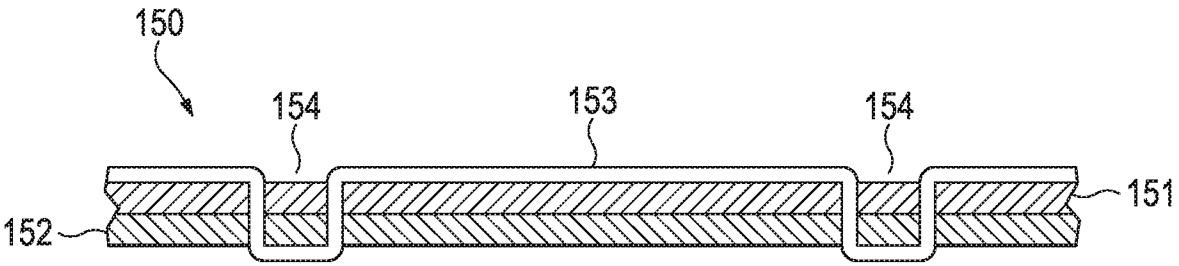
FIG. 12 is a cross-sectional view of the second waistband element, as defined by section line 12 in FIG. 11.

A waistband element 150 that may be utilized in waistband region 130 is depicted in FIGS. 11 and 12. More particularly, waistband element 150 is depicted as having a configuration that may form a portion of a rear area of waistband region 130. In other configurations, waistband element 150 may extend around substantially all of waistband region 130, or waistband element 150 may extend to a front area of waistband region 130.

The primary components of waistband element 150 are a first layer 151, a second layer 152, and a strand 153. First layer 151 may be formed from a variety of materials, including a stretch woven textile, non-stretch woven textile, knitted textile, non-woven textile, mesh textile, polymer sheet, natural or synthetic leather, or variety of other materials. Second layer 152 lays adjacent to first layer 151 and may be formed from any of the same materials. Strand 153 joins layers 151 and 152 and may be a filament, thread, yarn, or similar material formed from cotton, polyester, or nylon, for example.

In order to join layers 151 and 152, strand 153 extends through layers 151 and 152 in various stitch locations 154, as depicted in FIG. 12. In areas between stitch locations 154, strand 153 lays against a surface of layer 151 and may be unsecured to first layer 151. Various techniques may be utilized to join layers 151 and 152 with strand 153, including machine stitching, hand stitching, quilting, and embroidery, for example. Through many of these techniques, stitch locations 154 may be spaced from each other in a range of one to more than fifteen millimeters. In some configurations, stitch locations 154 may be spaced from each other by approximately two or five millimeters, for example. Moreover, strand 153 and stitch locations 154 extend throughout layers 151 and 152. That is, strand 153 and stitch locations 154 are located in peripheral areas of layers 151 and 152, and strand 153 and stitch locations 154 are located in central areas of layers 151 and 152. When distributed, stitch locations 154 may have a relatively constant density (i.e., average distance between adjacent stitch locations 154) throughout the areas where layers 151 and 152 are joined. Non-regular or uneven spacing for stitch locations 154 may also be utilized. Accordingly, strand 153 extends throughout layers 151 and 152 to join layers 151 and 152 to each other.

The general configuration discussed above for waistband element 150 may be utilized to impart limited stretch to waistband region 130. In configurations where first layer 151 is a stretch woven textile, second layer 152 may be a non-stretch woven textile. As such, the combination of layers 151 and 152 within waistband region 130 may have stretch characteristics that are limited by the properties of the non-stretch woven textile. In another configuration, second layer 152 may also be the stretch woven textile. Given that two elements of the stretch woven textile require twice as much tensile force to induce stretch of a certain percentage, this configuration may also be utilized to limit stretch. Although layers 151 and 152 may be formed from a variety of materials, advantages of forming layers 151 and 152 from textiles relates to breathability, flexibility, and economy of manufacture. As an additional matter, strand 153 may be utilized to limit stretch in waistband region 130. As noted above, strand 153 lays against layer 151 and may be unsecured to layer 151 between stitch locations 154. Referring to FIG. 11, strand 153 is also oriented to extend along the length of waistband element 150 and will, therefore, resist stretch in a direction extending around waistband region 130.

Figure 13A:
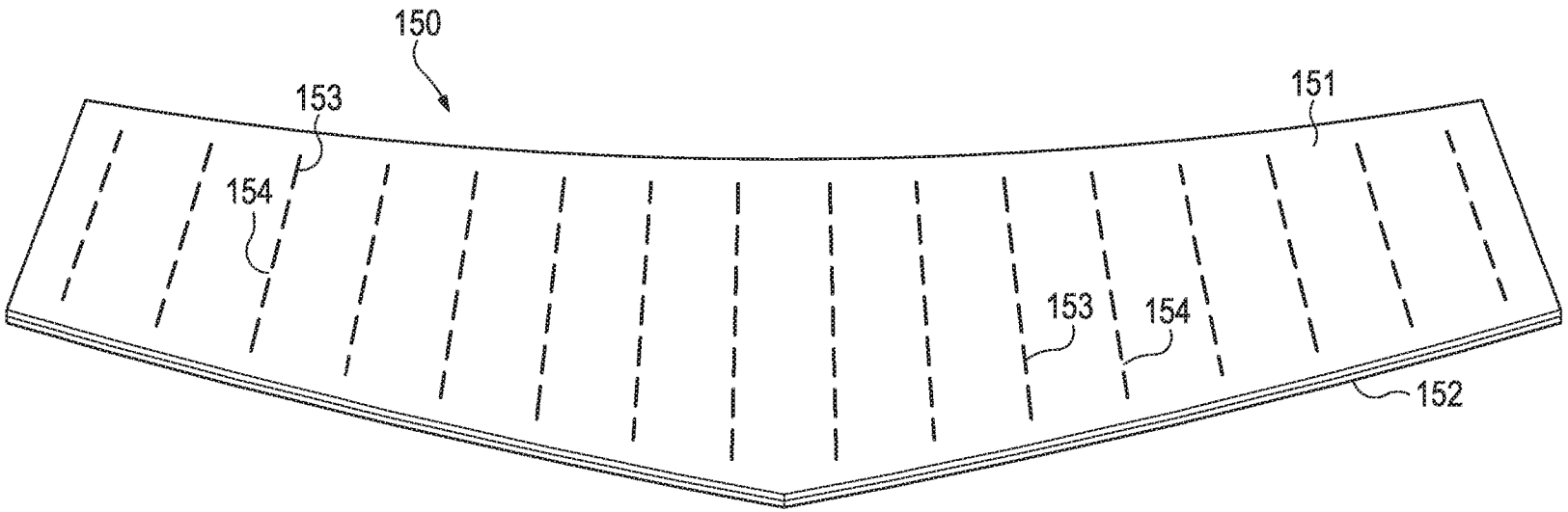
FIGS. 13A-13D are perspective views corresponding with FIG. 11 and depicting further configurations of the second waistband element.
Figure 13B:
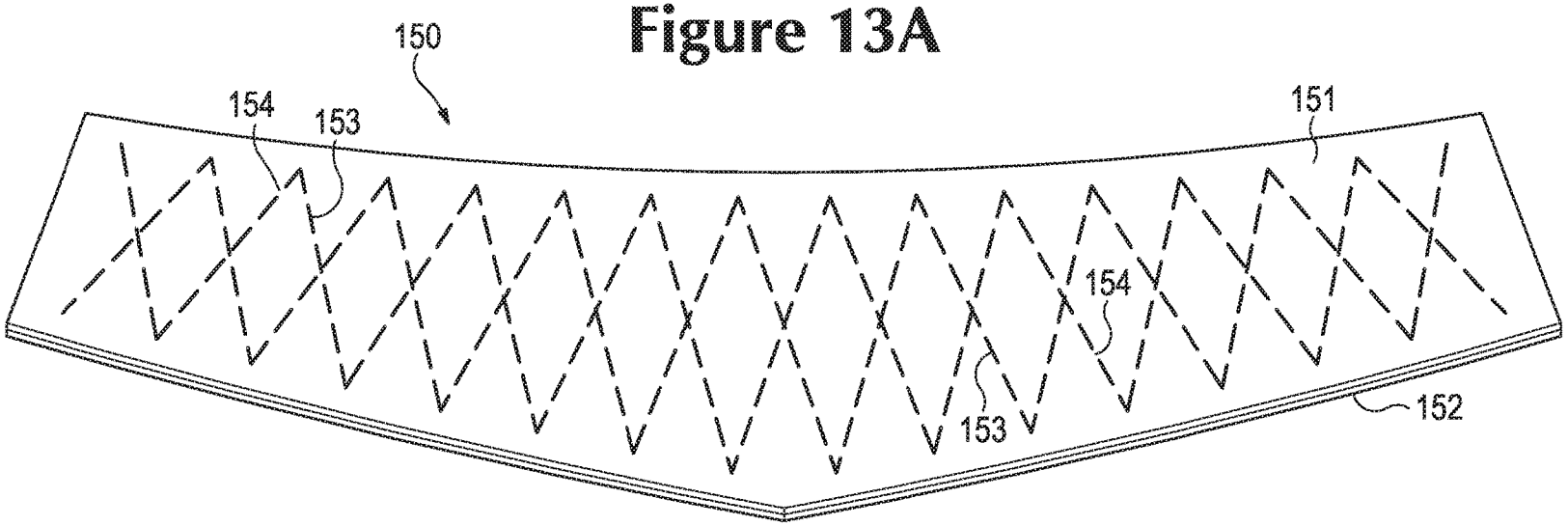
Figure 13C:
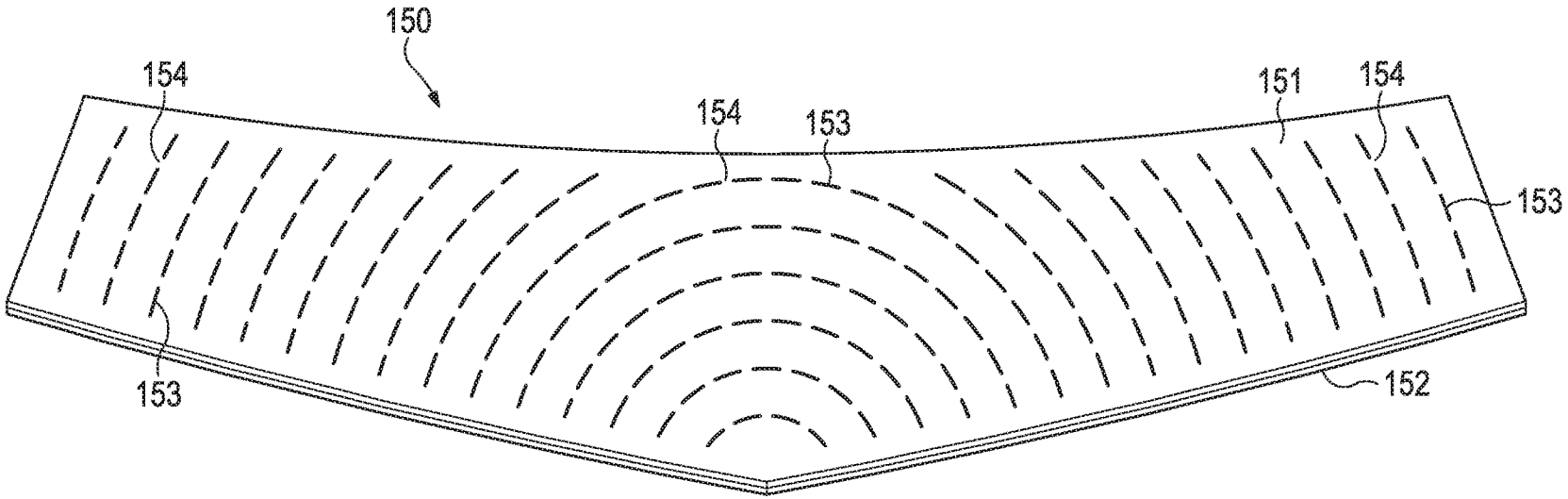
Figure 13D:
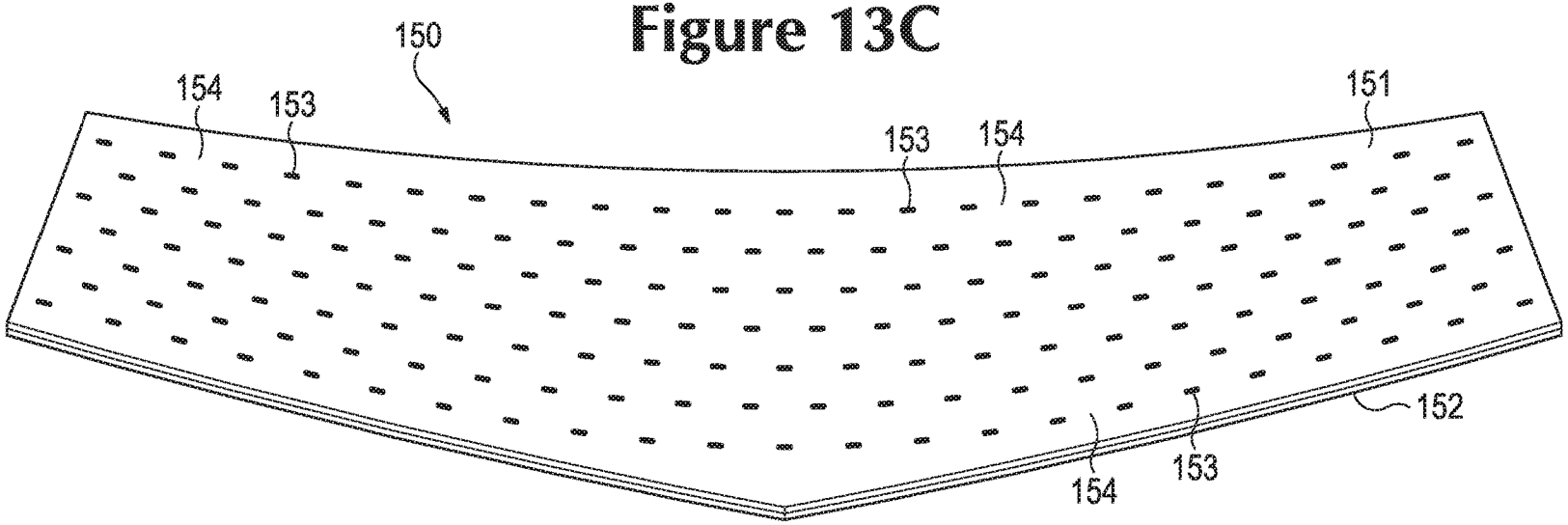

The configuration of waistband element 150 discussed above provides an example of the manner in which a layered configuration may be utilized to impart limited stretch to waistband region 130. A variety of other configurations may also be utilized. As an example, FIGS. 13A-13C depict strand 153 as being stitched in other configurations. More particularly, FIGS. 13A and 13B depict the stitching of strand 153 as extending diagonally along layers 151 and 152, and FIG. 13C depicts strand 153 as extending along a semi-circular path. Referring to FIG. 13D, each strand 153 is located at each of stitch locations 154, but is substantially absent from areas between stitch locations 154. As such, strand 153 may make a plurality of discrete stitches to join layers 151 and 152.

Figure 14A:
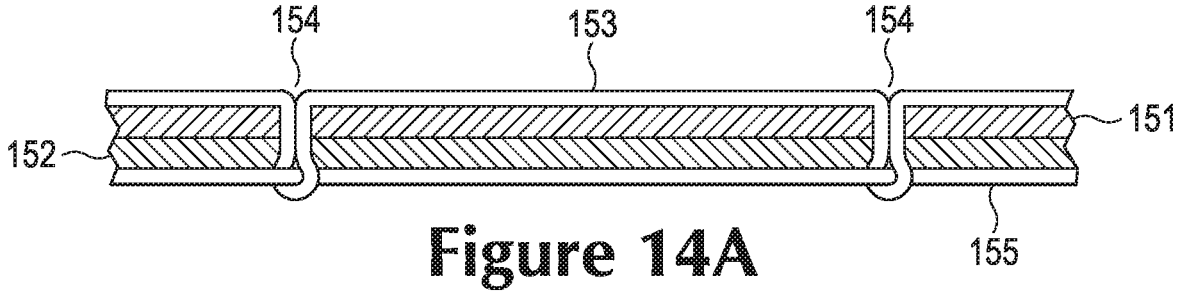
FIGS. 14A-14D are cross-sectional views corresponding with FIG. 12 and depicting further configurations of the second waistband element.
Figure 14B:
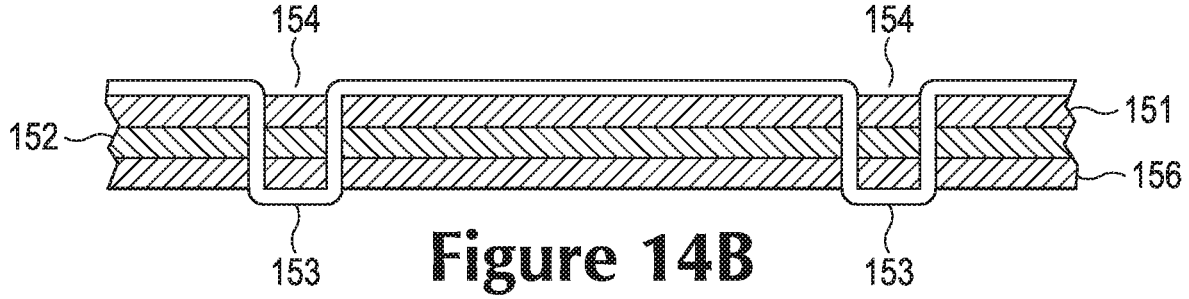
Figure 14C:
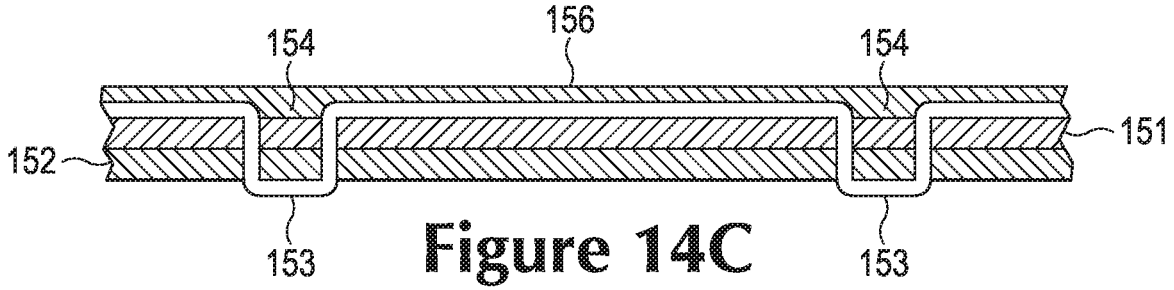

Continuing with further configurations of waistband element 150, FIG. 14A depicts the use of a lock stitch to join layers 151 and 152. More particularly, strand 153 extends along an upper surface of waistband element 150, passes through layers 151 and 152 in the various stitch locations 154, and is entwined with a lock strand 155 on an opposite lower surface of waistband element 150. An advantage to this configuration is that both strand 153 and lock strand 155 may resist stretch in waistband region 130. FIG. 14B depicts a third layer 156 as laying against second layer 152 and forming the lower surface of waistband element 150. In this configuration, second layer 152 may be a thermoplastic polymer element that joins layers 151 and 156 through thermal bonding. Moreover, this configuration may effectively combine the structures of waistband element 140 and waistband element 150, thereby limiting stretch in waistband region 130 through various methods. As another example, FIG. 14C depicts third layer 156 as being secured to first layer 151, with strand 153 being located between layers 151 and 156. In this configuration, third layer 153 effectively covers strand 153 and may impart protection to strand 153. When third layer 156 is formed from a polymer material (e.g., a thermoplastic polymer material), a portion of strand 153 (i.e., the portion laying against the surface of first layer 151) may be embedded within third layer 156 and may also be visible through third layer 156. Accordingly, strand 153 may be incorporated into layered structures in a variety of ways to impart limited stretch to waistband region 130.

Figure 14D:
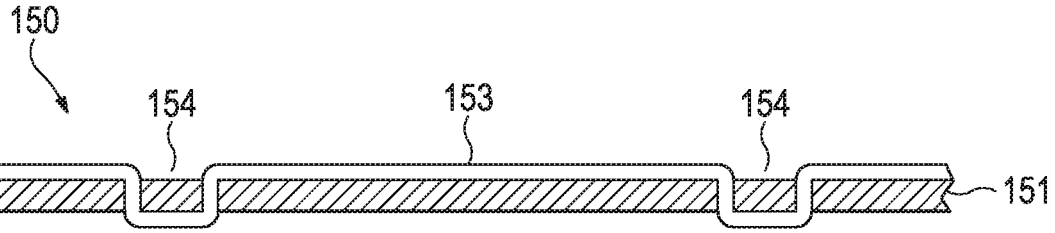

In some configurations, a strand may also impart limited stretch to a single layer configuration of waistband region 130. Referring to FIG. 14D, for example, strand 153 extends through first layer 151 in various stitch locations 154, and strand 153 lays against a surface of layer 151 and may be unsecured to first layer 151 between stitch locations 154. When first layer 151 is formed from a stretch textile or material, strand 153 may limit stretch in first layer 151. When first layer 151 is formed from a non-stretch textile or material, strand 153 may enhance durability and further limit stretch. Accordingly, strand 153 may be incorporated into layered or single layer structures in a variety of ways to impart limited stretch to waistband region 130.

Third Waistband Configuration

Figure 15:
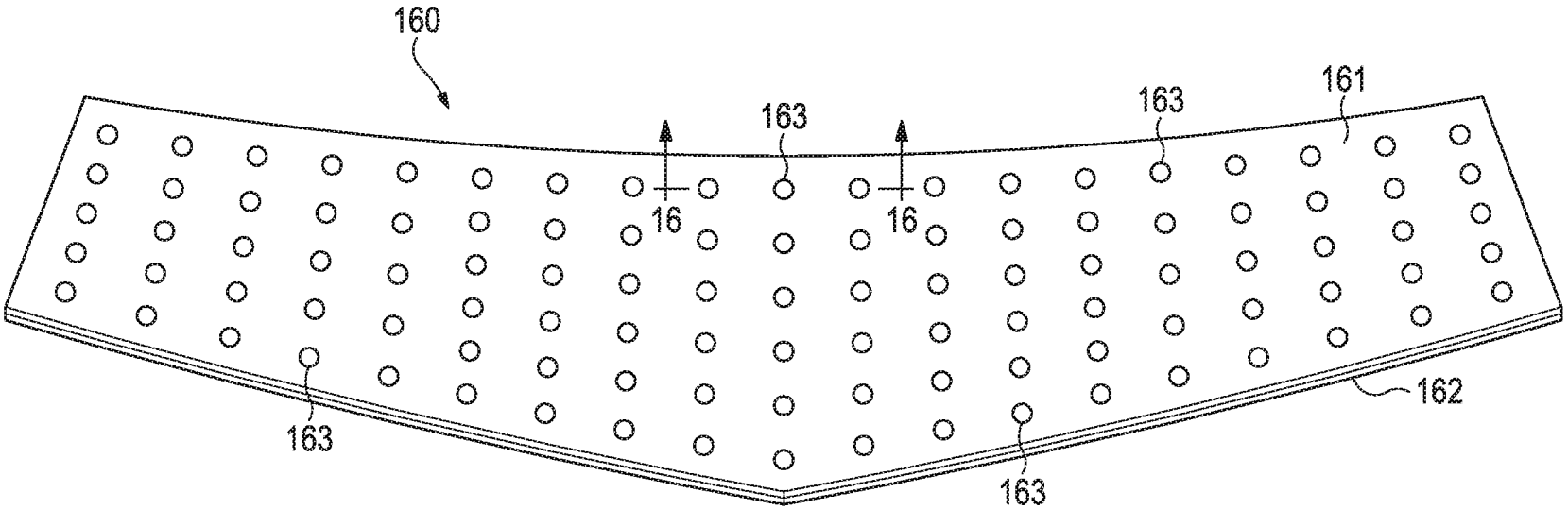
FIG. 15 is a perspective view of a third waistband element that may form a portion of the waistband.
Figure 16:
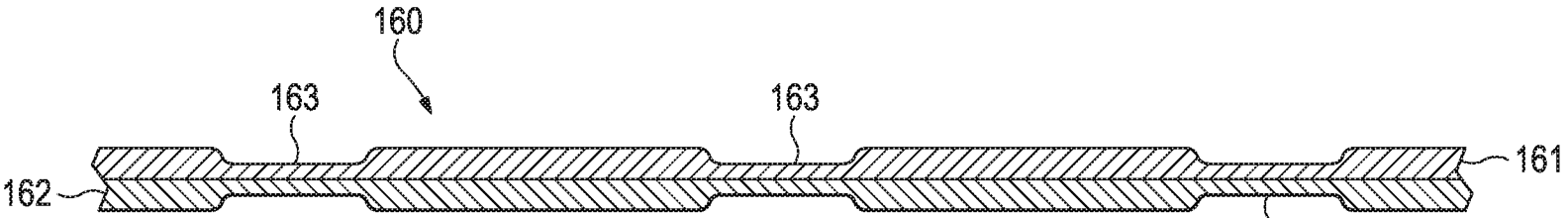
FIG. 16 is a cross-sectional view of the third waistband element, as defined by section line 16 in FIG. 15.

A waistband element 160 that may be utilized in waistband region 130 is depicted in FIGS. 15 and 16. More particularly, waistband element 160 is depicted as having a configuration that may form a portion of a rear area of waistband region 130. In other configurations, waistband element 160 may extend around substantially all of waistband region 130, or waistband element 160 may extend to a front area of waistband region 130.

The primary components of waistband element 160 are a first layer 161 and a second layer 162. First layer 161 may be formed from a variety of materials, including a stretch woven textile, non-stretch woven textile, knitted textile, nonwoven textile, mesh textile, polymer sheet, natural or synthetic leather, or variety of other materials. Second layer 162 lays adjacent to first layer 161 and may be formed from any of the same materials. In selecting materials for layers 161 and 162, consideration may be given to impart stretch reduction or other properties to waistband element 160.

Layers 161 and 162 are joined to each other at a plurality of discrete bond areas 163 that are distributed over waistband element 160. Moreover, bond areas 163 extend throughout layers 161 and 162. That is, bond areas 163 are located in peripheral areas of layers 161 and 162, and bond areas 163 are located in central areas of layers 161 and 162. Accordingly, bond areas 163 are located throughout layers 161 and 162 to join layers 161 and 162 to each other. In many configurations, bond areas 163 have a regular or even spacing from each other. That is, the distance between two adjacent bond areas 163 may be relatively even throughout waistband element 160. When distributed, bond areas 163 may have a relatively constant density (i.e., average distance between adjacent bond areas 163) throughout the areas where layers 161 and 162 are joined. Non-regular or uneven spacing for bond areas 163 may also be utilized.

A variety of processes may be utilized to join layers 161 and 162 at bond areas 163, including thermal bonding. That is, bond areas 163 may be a plurality of thermal bonds. In addition to forming bond areas 163 through heated elements that contact layers 161 and 162 at bond areas 163, radio frequency bonding and sonic bonding may be utilized. In areas between bond areas 163, layers 161 and 162 may lay against each other and be unsecured to each other.

The general configuration discussed above for waistband element 160 may be utilized to impart limited stretch to waistband region 130. In configurations where first layer 161 is a stretch woven textile, second layer 162 may be a non-stretch woven textile. As such, the combination of layers 161 and 162 within waistband region 130 may have stretch characteristics that are limited by properties of the non-stretch woven textile. In another configuration, second layer 162 may also be the stretch woven textile. Given that two elements of the stretch woven textile require twice as much tensile force to induce stretch of a certain percentage, this configuration may also be utilized to limit stretch. In yet another configuration, second layer 162 may be a thermoplastic polymer sheet that bonds with first layer 161 and limits stretch.

Figure 17A:
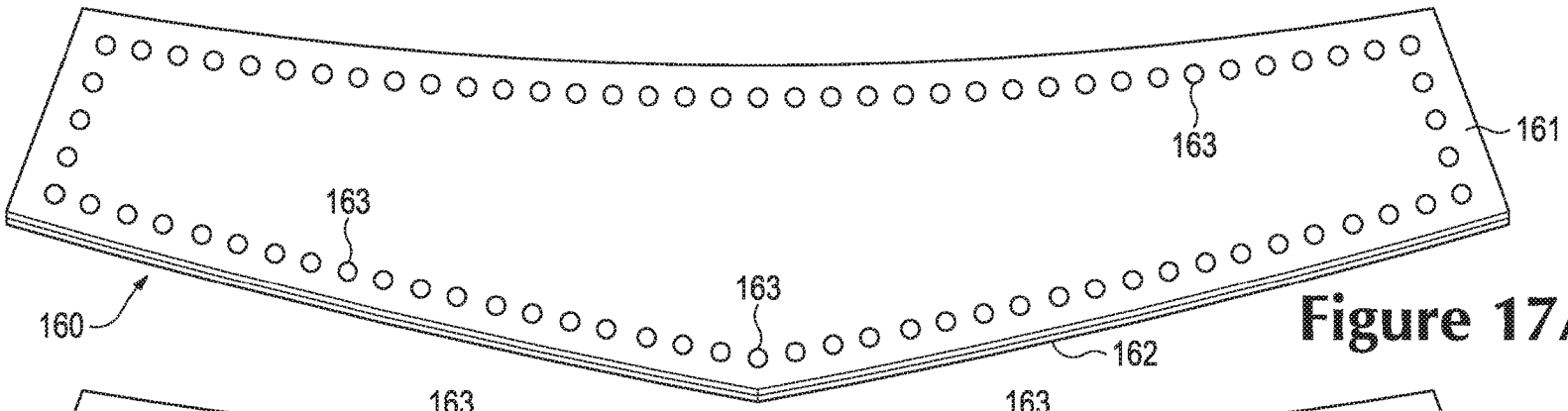
FIGS. 17A-17C are perspective views corresponding with FIG. 15 and depicting further configurations of the third waistband element.
Figure 17B:
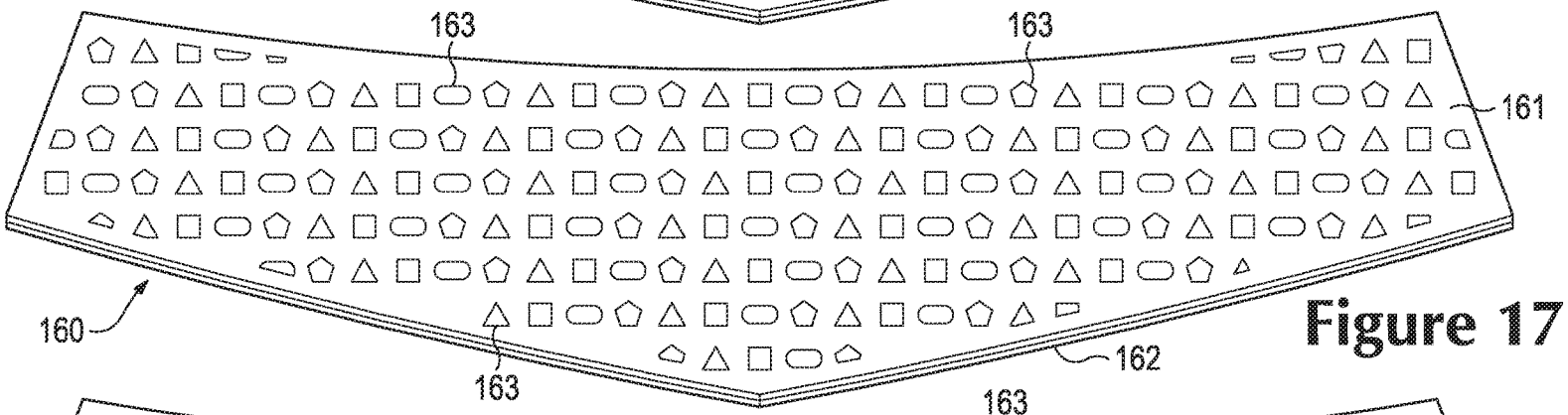
Figure 17C:
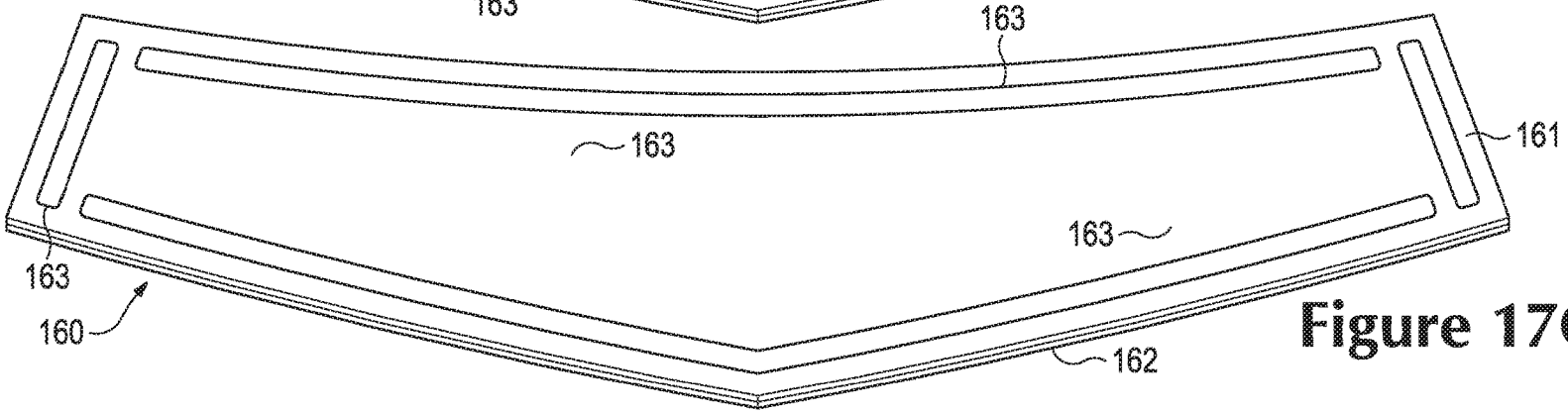

The configuration of waistband element 160 discussed above provides an example of the manner in which a layered configuration may be utilized to impart limited stretch to waistband region 130. A variety of other configurations may also be utilized. As an example, FIGS. 17A-17C depict different configurations for bond areas 163. More particularly, FIG. 17A depicts bond areas 163 as being located around a periphery of layers 161 and 162. As opposed to circular bond areas 163, FIG. 17B depicts bond areas 163 as having various shapes, including square, triangular, rectangular, elliptical, and linear, although various other geometric or irregular shapes may also be utilized. Additionally, FIG. 17C depicts bond areas 163 as having various elongate shapes located at a perimeter of waistband element 160 and extending through a width of waistband element 160.

Figure 18A:
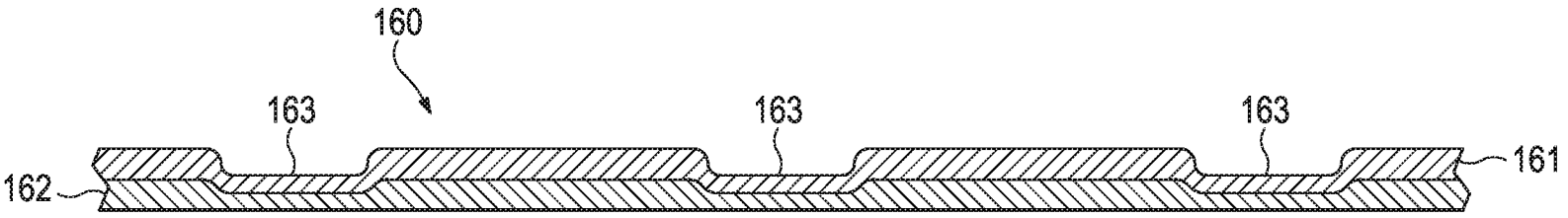
FIGS. 18A-18C are cross-sectional views corresponding with FIG. 16 and depicting further configurations of the third waistband element.
Figure 18B:
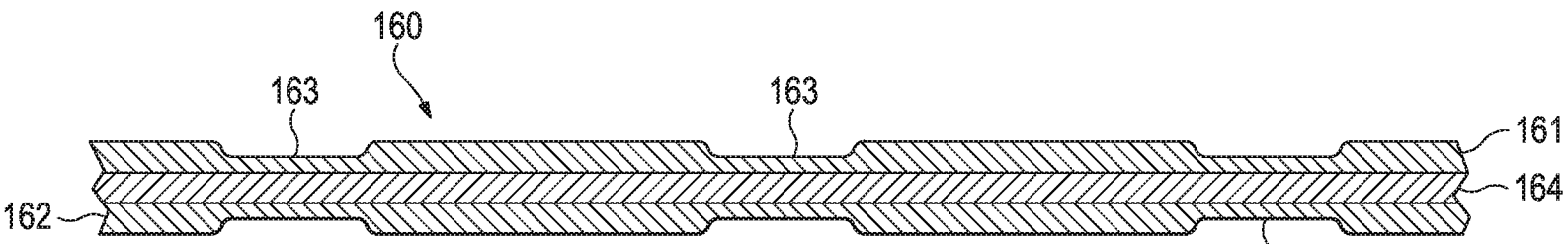
Figure 18C:
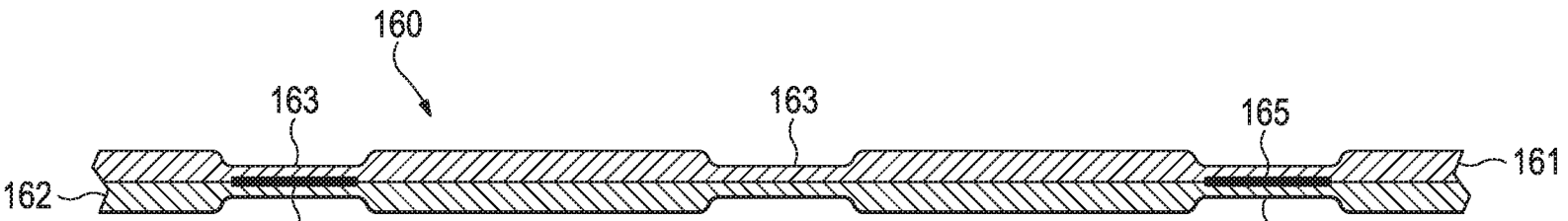

Continuing with further configurations of waistband element 160, FIG. 18A depicts depressions at bond areas 163 as being in first layer 161, but not to the same degree in second layer 162. In this configuration, the greater depth of the depressions may enhance the aesthetic appearance of apparel 100. In FIG. 18B, a third layer 164 is located between layers 161 and 162. Third layer 164 may be another element of the stretch woven textile, a non-stretch woven textile, a polymer sheet, leather, synthetic leather, a mesh, non-woven textile, or a variety of other materials that impart further stretch reduction or other properties to waistband element 160. In some examples, third layer 164 may incorporate a thermoplastic polymer material that facilitates bonding (e.g., thermal bonding) between layers 161 and 162. As another example, FIG. 18C depicts various bonding elements 165 as being located at bond areas 163 to facilitate bonding. Although bonding elements 165 are discrete elements located only at bond areas 163, a single bonding element 165 having a configuration of a sheet that extends through a relatively large area of waistband element 160 may also be utilized. Moreover, bonding elements 165 may also be utilized in any of the configurations discussed above. Accordingly, various configurations of a layered structure incorporating bonds may impart limited stretch to waistband region 130.

Fourth Waistband Configuration

Figure 19:
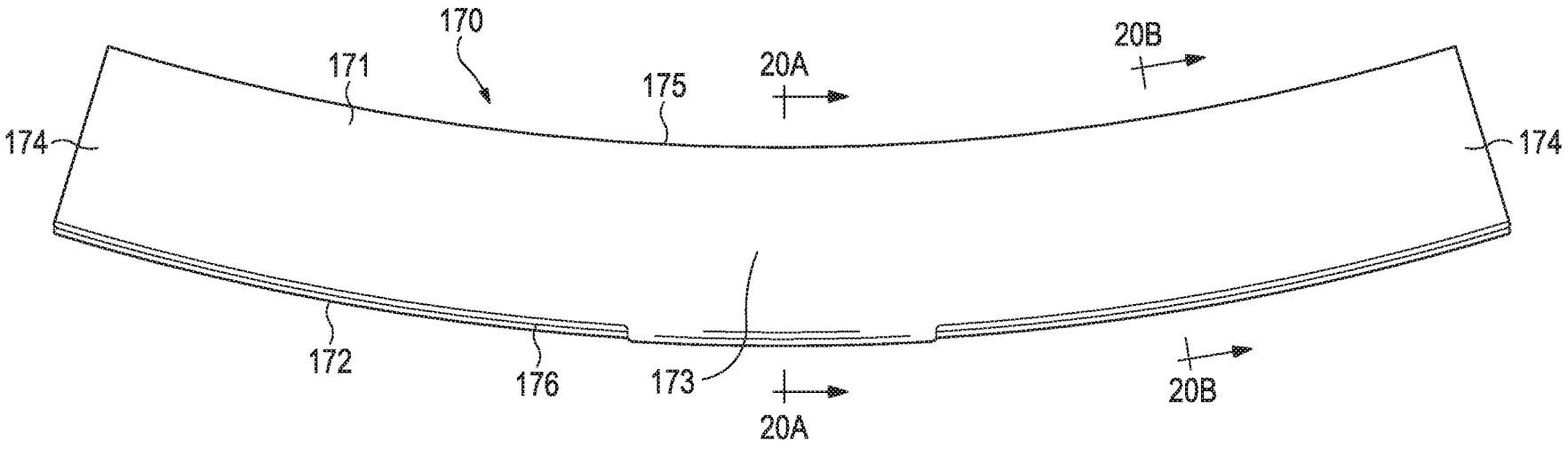
FIG. 19 is a perspective view of a fourth waistband element that may form a portion of the waistband.
Figure 20B:
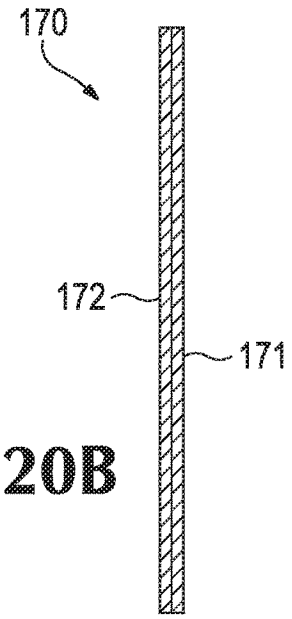
FIGS. 20A and 20B are cross-sectional views of the fourth waistband element, as defined by section lines 20A and 20B in FIG. 19.
Figure 20A:
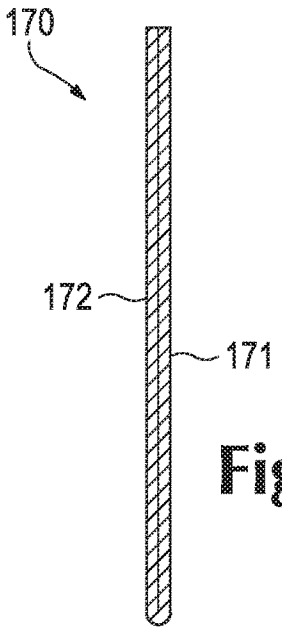

A waistband element 170 that may be utilized in waistband region 130 is depicted in FIGS. 19, 20A, and 20B. More particularly, waistband element 170 is depicted as having a configuration that may form a portion of a front area of waistband region 130. In other configurations, waistband element 140 may extend around substantially all of waistband region 130, or waistband element 140 may extend to a rear area of waistband region 130.

Waistband element 170 has a generally elongate and curved or arcuate shape that follows the contour of the front area of waistband region 130 and includes a first layer 171 and a second layer 172 positioned adjacent to each other. Layers 171 and 172 have an elongate and curved shape. More particularly, waistband element 170, as well as each of layers 171 and 172, has a central area 173 and two end areas 174 located on opposite sides of central area 173. Waistband element 170, as well as each of layers 171 and 172, also has a concave edge 175 and an opposite convex edge 176 extending through a length of the waistband element 170 (i.e., between end areas 174). Moreover, convex edge 176 of first layer 171 is unitarily-joined to convex edge 176 of second layer 172. As such, layers 171 and 172 have a one-piece configuration.

Given that layers 171 and 172 are unitarily-joined to have a one-piece configuration, layers 171 and 172 are formed from a common material. That is, the material forming first layer 171 is the same as the material forming second layer 172. Both layers 171 and 172 in waistband element 170 may be formed, therefore, from a stretch woven textile, non-stretch woven textile, knitted textile, non-woven textile, mesh textile, polymer sheet, natural or synthetic leather, or variety of other materials that impart stretch reduction or other properties to waistband element 170.

Figure 21:
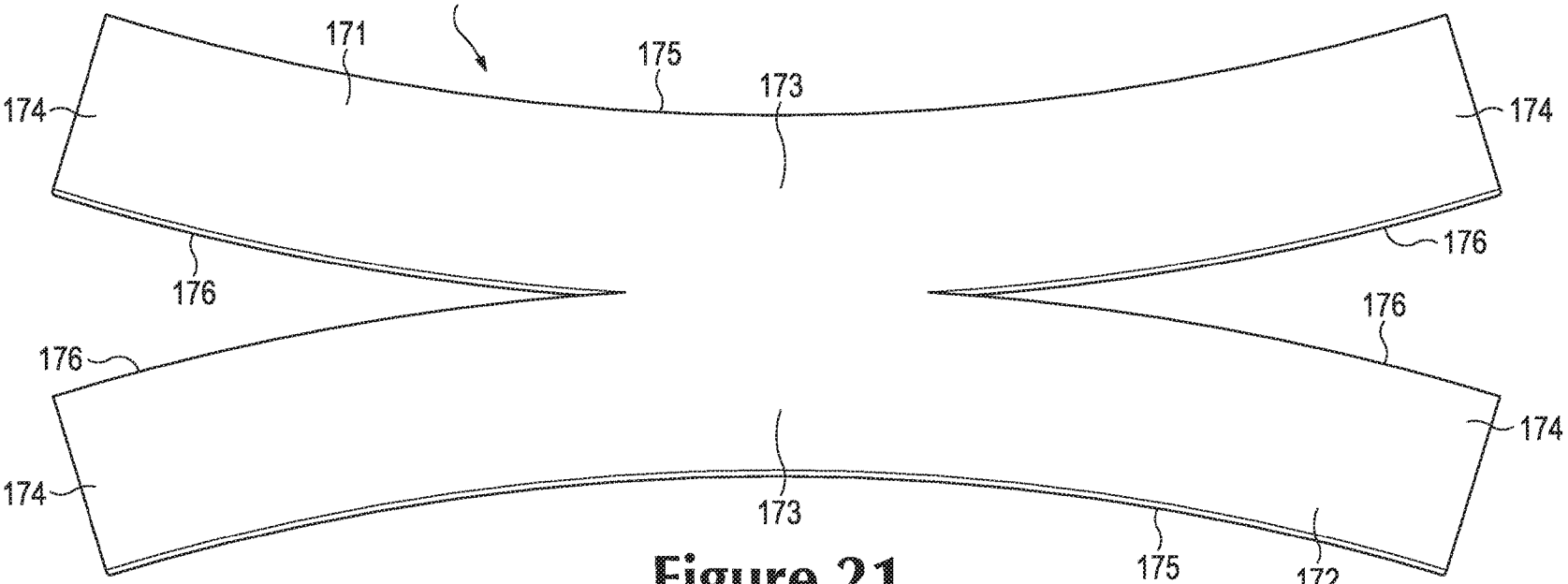
FIG. 21 is a plan view of the fourth waistband element in an unfolded configuration.

In addition to being formed from the same material, layers 171 and 172 may be formed from the same element of material. That is, a single element of material is utilized to form both layers 171 and 172. This feature is depicted, for example, in FIG. 20A, where the material bends or folds to place layers 171 and 172 adjacent to each other. Additionally, this feature is depicted in FIG. 21, wherein waistband element 170 is in an unfolded configuration and has a shape of two elongate and curved sections (i.e., layers 171 and 172) with central areas 173 being unitarily-joined to each other.

As noted above, waistband element 170 may be formed from a variety of materials. As an example, waistband element 170 may be formed from a stretch woven textile. Although the stretch woven textile stretches, two layers of the stretch woven textile require twice as much tensile force to induce stretch of a certain percentage. Alternately, waistband element 170 may be formed from a non-stretch woven textile. Accordingly, a variety of materials may be utilized in waistband element 170 to impart limited stretch to waistband region 130.

Figure 22A:
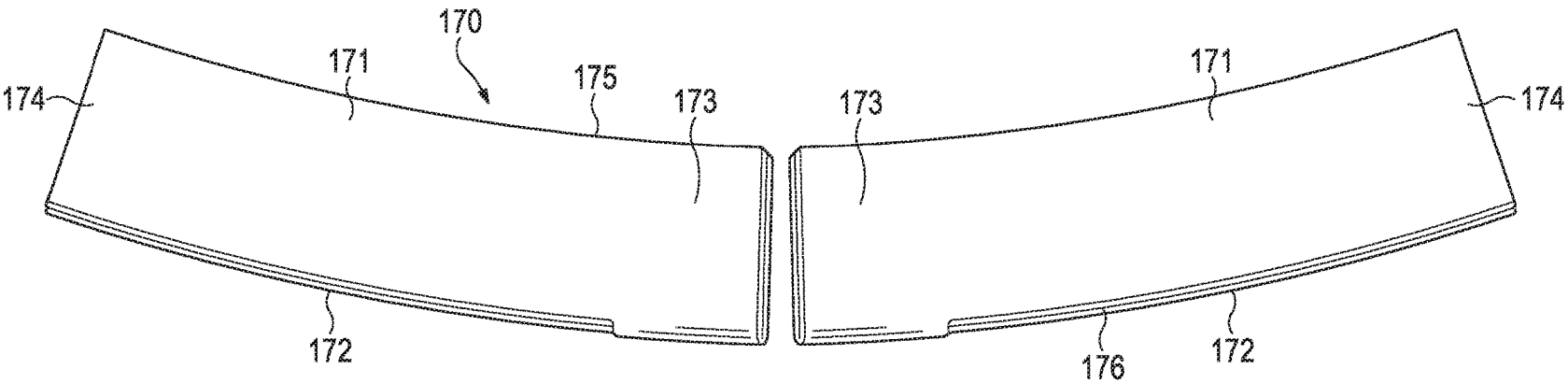
FIGS. 22A and 22B are perspective views corresponding with FIG. 19 and depicting further configurations of the fourth waistband element.
Figure 22B:
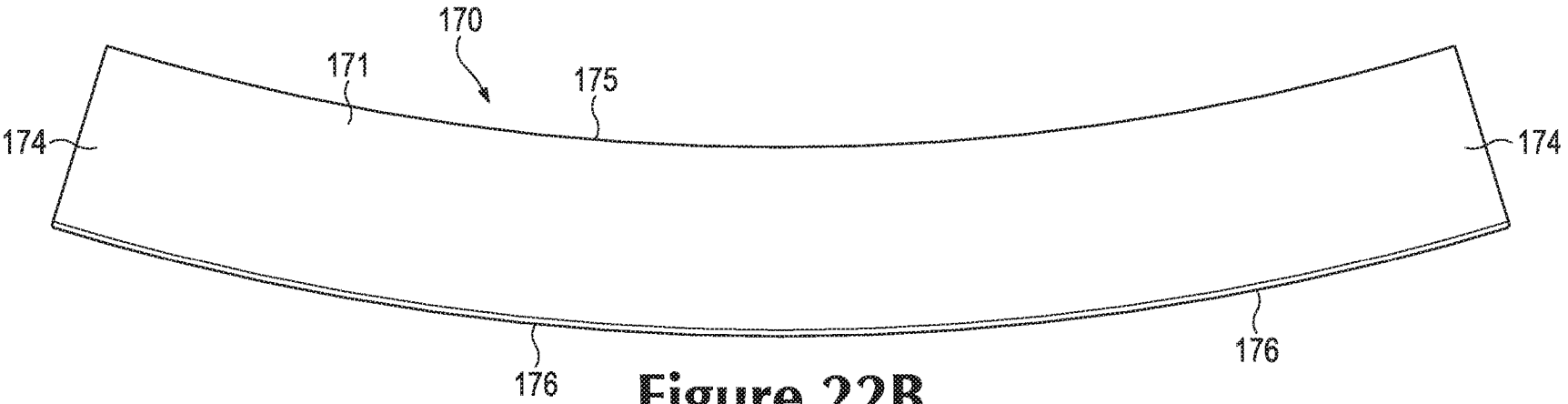
Figure 23:
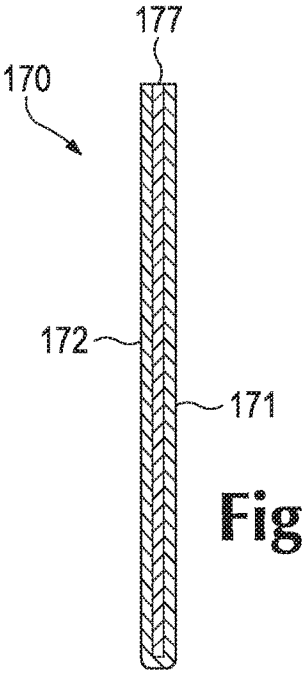
FIG. 23 is a cross-sectional view corresponding with FIG. 20A and depicting a further configuration of the fourth waistband element.

The configuration of waistband element 170 discussed above provides an example of the manner in which a layered configuration may be utilized to impart limited stretch to waistband region 130. A variety of other configurations may also be utilized. As an example, FIG. 22A depicts a configuration including two separate portions, which are divided at central area 173, and may be located on opposite sides of lace 131 and apertures 132 when incorporated into waistband region 130. In this configuration, each of the separate portions include unitarily-joined parts of layers 171 and 172. As another example, FIG. 22B depicts waistband element 170 as having a configuration of a single, curved layer having the shape of one of layers 171 and 172. Additionally, FIG. 23 depicts a configuration wherein a third layer 177 is located between layers 171 and 172. Third layer 177 may be a stretch woven textile, non-stretch woven textile, knitted textile, non-woven textile, mesh textile, polymer sheet, natural or synthetic leather, or variety of other materials that impart further stretch reduction or other properties to waistband element 170. In some examples, third layer 177 may incorporate a thermoplastic polymer material that facilitates thermal bonding between layers 171 and 172. Accordingly, various configurations of a layered structure may impart limited stretch to waistband region 130.

Fifth Waistband Configuration

Figure 24A:
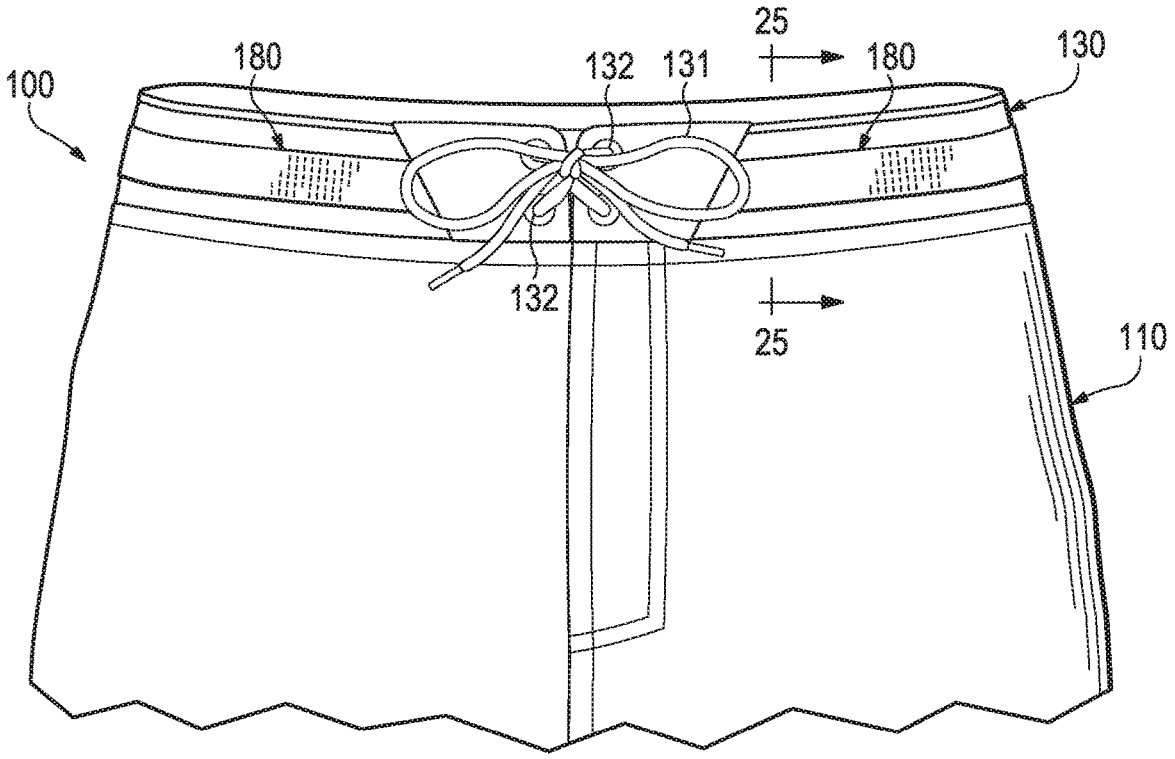
FIGS. 24A-24C are partial elevational views depicting another configuration of the article of apparel.
Figure 24B:
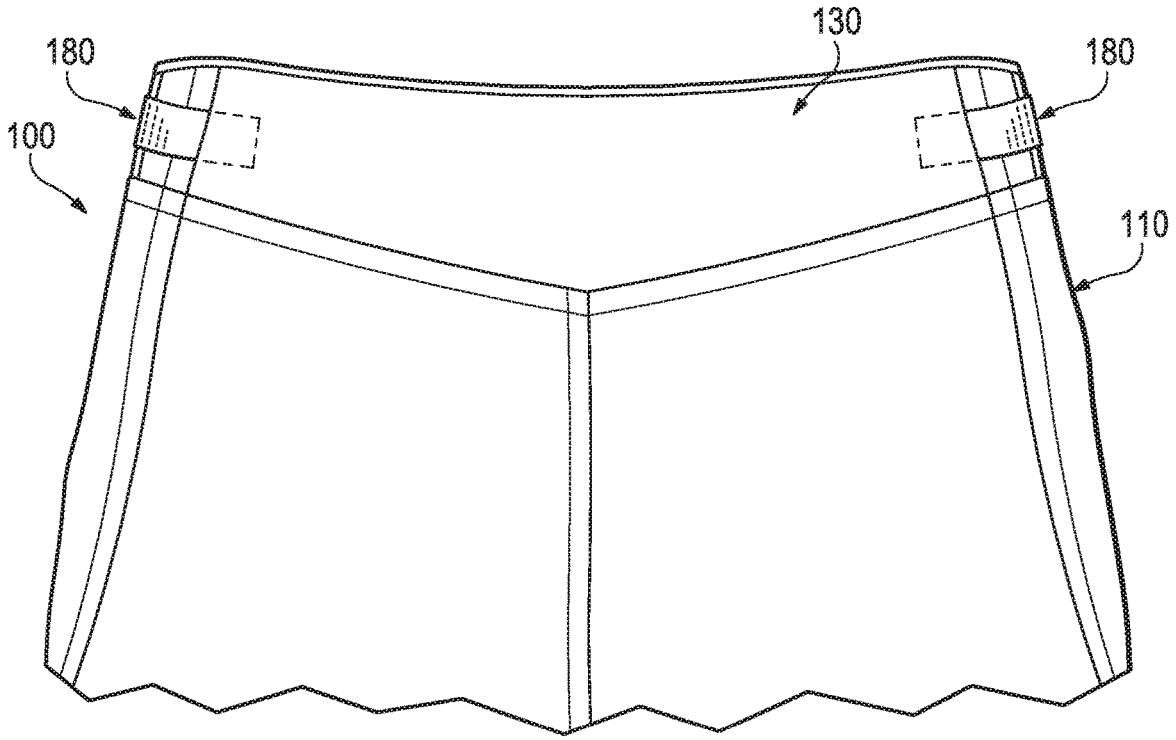
Figure 24C:
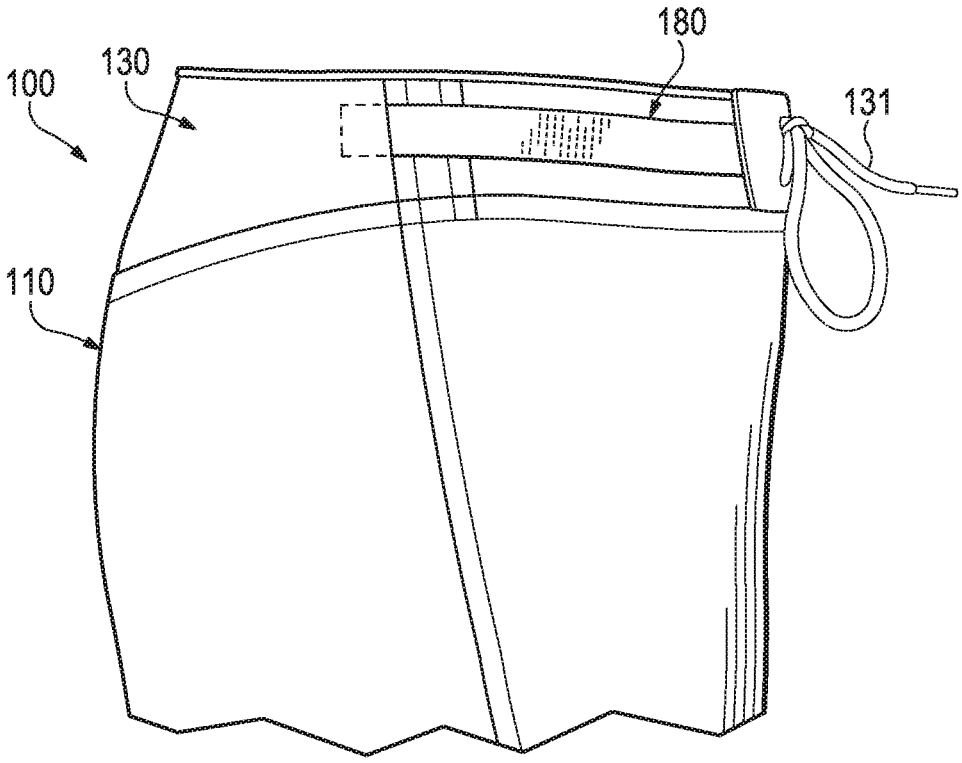

Another configuration of apparel 100 is depicted in FIGS. 24A-24C as including a tensile component 180 extending through waistband region 130. Tensile component 180 extends at least partially around waistband region 130. More particularly, two parts of tensile component 180 extend from opposite sides of a lace area (i.e., the area of lace 131 and apertures 132) to a rear area of waistband region 130. As such, tensile component 180 extends from a front area of waistband region 130, around sides of waistband region 130, and to the rear area. Although tensile component 180 is depicted as being absent from a portion of the rear area, tensile component 180 may also extend through the rear area, as shown in another configuration discussed below. Additionally, tensile component 180 may have a variety of generally elongate and relatively non-stretch configurations, with examples including elements of rope, webbing, tape (e.g., grosgrain tape), cord, textile strips, braided yarns, and lace. In some configurations, tensile component 180 may have a generally planar configuration with a width of at least one centimeter, which may enhance the comfort of apparel 100.

Figure 25:
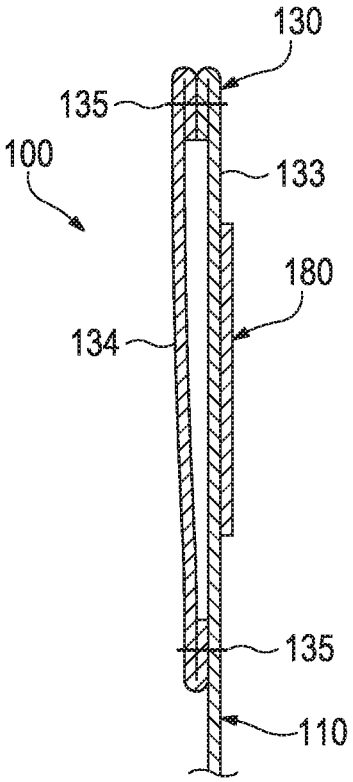
FIG. 25 is a cross-sectional view, as defined by section line 25 in FIG. 24A.

In the area of tensile component 180, waistband region 130 may be formed from a first layer 133 and a second layer 134 that are joined with stitching 135, as depicted in FIG. 25. Layers 133 and 134 may be formed from a variety of materials, including a stretch woven textile, non-stretch woven textile, knitted textile, non-woven textile, mesh textile, polymer sheet, natural or synthetic leather, or variety of other materials. In other configurations, waistband region 130 may include tensile component 180 in combination with any of waistband elements 140, 150, 160, or 170.

Tensile component 180 lays against the exterior surface of waistband region 130 (i.e., against first layer 133). More particularly, a surface of the generally planar configuration of tensile component 180 lays against a material element of waistband region 130, such as first layer 133. Although tensile component 180 may be secured to waistband region 130, various areas of tensile component 180 may be unsecured. For example, end portions of tensile component 180 (i.e., adjacent to lace area and in the rear area) may be secured to waistband region 130, but central portions of tensile component 180 may be unsecured to permit relative movement between waistband region 130 and tensile component 180. In other configurations, substantially all of the length of tensile component 180 may be bonded, stitched, or otherwise secured to waistband region 130.

Tensile component 180 provides the advantage of limiting stretch in waistband region 130. When lace 131 is tensioned and tied, a tensile force may extend through waistband region 130. That is, tensioning and tying lace 130 may tend to stretch waistband region 130. Tensile component 180, however, is secured to waistband region 130 adjacent to the lace area and extends at least partially around waistband region 130. In many configurations, tensile component 180 extends around at least thirty percent of waistband region 130. As such, the tensile force that would otherwise stretch waistband region 130 is resisted by tensile component 180. Accordingly, the presence of tensile component 180 may impart limited stretch to waistband region 130.

Figure 26A:
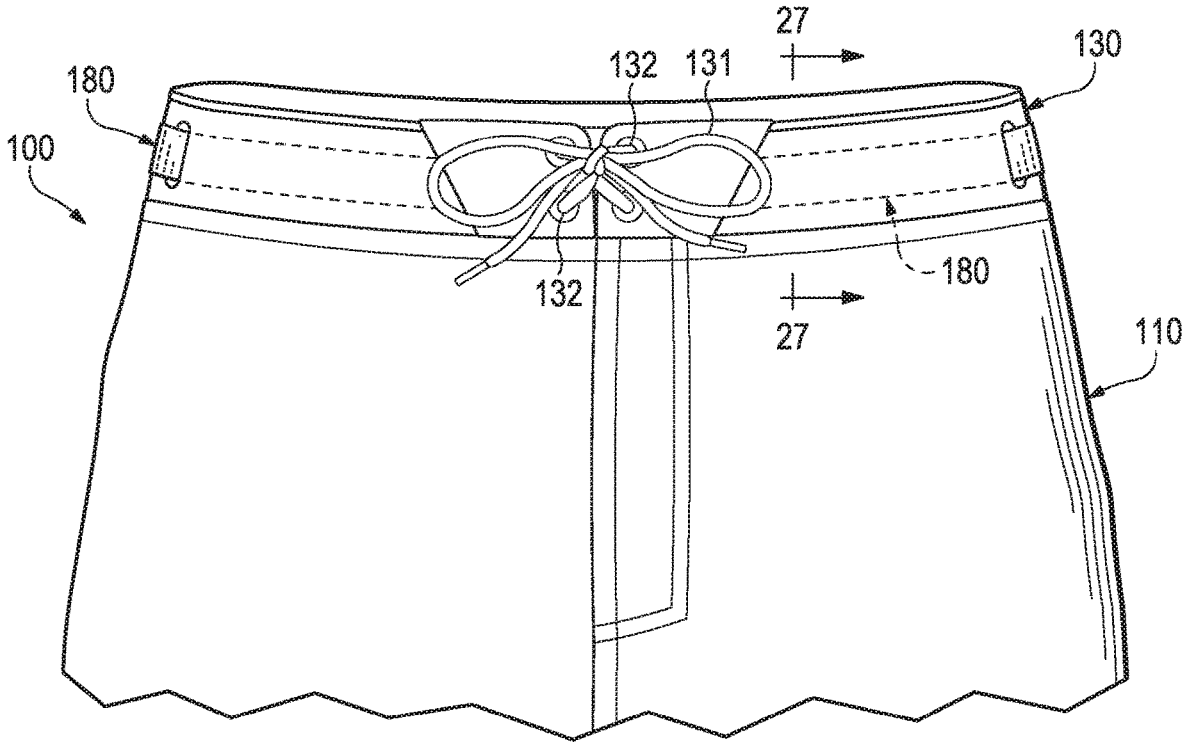
FIGS. 26A-26C are partial elevational views depicting yet another configuration of the article of apparel.
Figure 26B:
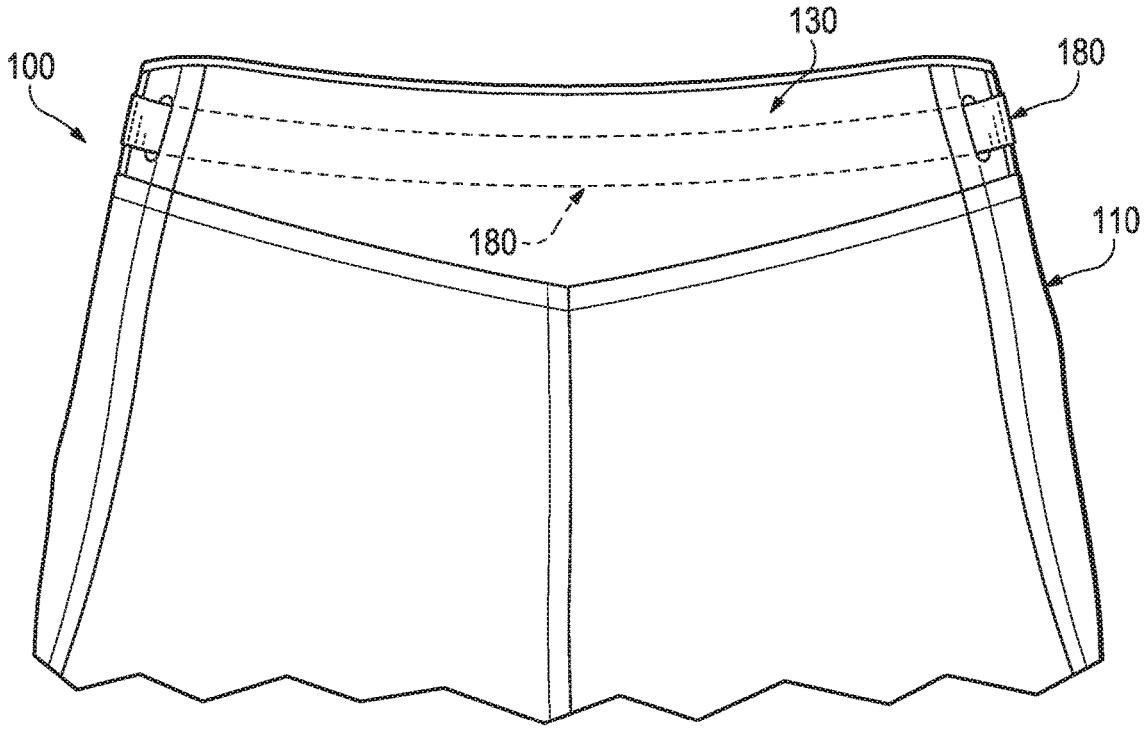
Figure 26C:
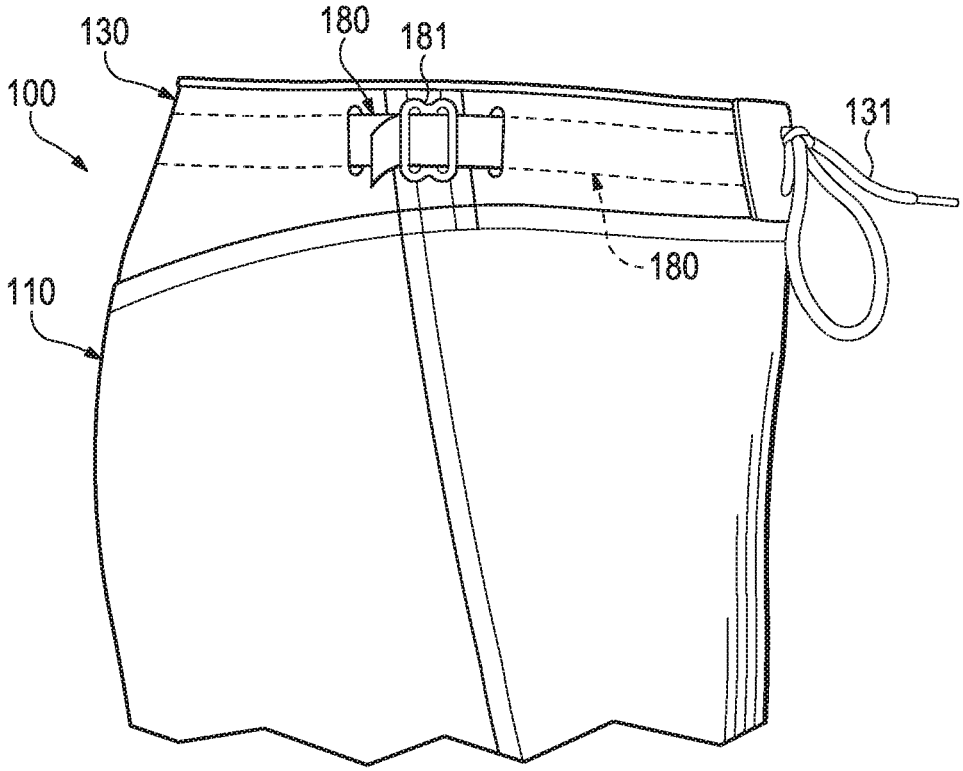
Figure 27:
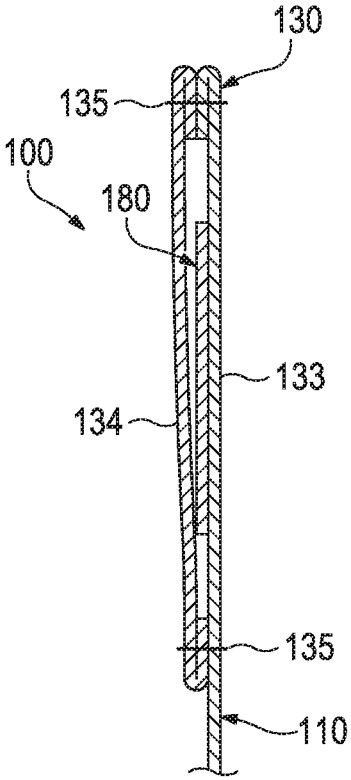
FIG. 27 is a cross-sectional view, as defined by section line 27 in FIG. 26A.

The configuration of waistband region 130 discussed above provides an example of the manner in which tensile component 180 may be utilized to impart limited stretch to apparel 100. A variety of other configurations may also be utilized. As an example, FIGS. 26A-26C and 27 depict a configuration wherein a majority of tensile component 180 is located within waistband region 130 (i.e., between layers 133 and 134). On side areas of waistband region 130, as depicted in FIG. 26C, however, tensile component 180 protrudes through first layer 133 and is exposed. Moreover, two adjustment rings 181 are present in the exposed area for purposes of modifying the effective length of tensile component 180. That is, individual 10 may modify the length of tensile component 180 through manipulation of an adjustment mechanism, such as adjustment rings 181. An advantage of this configuration is that the effective length of tensile component 180 may be adjusted to suit the comfort or activities of individual 10. As such, individual 10 may prefer that tensile component 180 be shorter (i.e., tighter) while engaging in aquatic activities, and individual 10 may prefer that tensile component 180 be longer (i.e., looser) while engaging in land-based activities. Accordingly, the presence of tensile component 180 and adjustment rings 181 may impart adjustability to the stretch in waistband region 130. In another configuration, tensile component 180 may be unexposed on the side areas and entirely located within waistband region 130 (i.e., between layers 133 and 134).

CONCLUSION

The above discussion and accompanying figures disclose various concepts associated with waistband configurations having limited stretch. Whether formed from stretch woven textiles, non-stretch woven textiles, other textiles, or a variety of other materials, the waistband configurations may be utilized to impart limit stretch in apparel, such as water shorts. With regard to limiting stretch, elements 140, 150, 160, and 170, as well as tensile component 180, are disclosed. The discussion of these elements and components is not intended to suggest that a waistband includes only these elements and components. Rather, a waistband may also include a variety of additional elements, such as further material layers, grommets, buttons, trademark indicia, stitching, seams, tags, and other conventional or non-conventional apparel elements. Accordingly, the configurations discussed herein may be used alone or in combination with a variety of other apparel elements.

The invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. A waistband for an article of apparel, comprising:

a waistband element including:

a textile element having a first planar surface, a second surface opposite the first planar surface, and a top textile edge associated with an opening in the waistband element; and a polymer element having a continuous top perimeter edge, a continuous bottom perimeter edge, and a web of polymer material extending between the continuous top perimeter edge and the continuous bottom perimeter edge, wherein the polymer element is made of a single polymer material, wherein the continuous top perimeter edge is positioned adjacent the top textile edge, the web of polymer material having a plurality of intersecting rows, the plurality of intersecting rows defining a plurality of apertures formed through the polymer element, wherein the entire polymer element is thermally bonded to the first planar surface of the textile element such that each row of the plurality of intersecting rows of the polymer element is melted to adhere to the first planar surface of the textile element, the polymer element having a first side opposite a second side, the continuous top perimeter edge extending from the first side to the second side in parallel with the top textile edge, the bottom continuous perimeter edge extending from the first side to a midpoint and onto the second side, the continuous bottom perimeter edge diverging from the continuous top perimeter edge from the first side to the midpoint and converging with the continuous top perimeter edge from the midpoint to the second side, wherein the midpoint is centered on a back of the article of apparel, wherein the bottom continuous perimeter edge transitions from diverging to converging only at the midpoint.

2. The waistband of claim 1, wherein the plurality of intersecting rows of the web of polymer material define a first surface and an opposite second surface of the polymer element, wherein an entire area of the first surface of the web of polymer material is bonded to the first planar surface of the textile element.

3. The waistband of claim 1, wherein the textile element comprises a uniform thickness, and wherein the first planar surface of the textile element is exposed through each of the plurality of apertures.

4. A waistband for an article of apparel, comprising:

a waistband element comprising:

a textile element having at least a first planar surface and a second surface opposite the first planar surface; and a polymer element having a continuous top perimeter edge, a continuous bottom perimeter edge, and a web of polymer material extending between the continuous top perimeter edge and the continuous bottom perimeter edge, wherein the polymer element is made of a single polymer material, the web of polymer material having a plurality of intersecting rows extending from the continuous top perimeter edge to the continuous bottom perimeter edge , the plurality of intersecting rows defining a plurality of apertures formed through the polymer element, wherein the entire polymer element is thermally bonded to the first planar surface of the textile element such that each row of the plurality of intersecting rows is melted to adhere to the first planar surface of the textile element to form an overlay on the first planar surface of the textile element, wherein the first planar surface of the textile element is exposed through the plurality of apertures, the web of polymer material having a first side opposite a second side, the continuous top perimeter edge extending from the first side to the second side, the bottom continuous perimeter edge extending from the first side to a midpoint and onto the second side, the continuous bottom perimeter edge diverging from the continuous top perimeter edge from the first side to the midpoint and converging with the continuous top perimeter edge from the midpoint to the second side, wherein the midpoint is centered on a back of the article of apparel, wherein the bottom continuous perimeter edge transitions from diverging to converging only at the midpoint, wherein the continuous top perimeter edge is not a row of the plurality of intersecting rows of the web of polymer material.

5. The waistband of claim 4, wherein the textile element comprises a stretch-woven textile.

6. The waistband of claim 4, wherein the single polymer material comprises a thermoplastic polyurethane.

7. A waistband for an article of apparel comprising:

a waistband element comprising at least:

a textile element having at least a first planar surface and a second surface opposite the first planar surface, the textile element having a uniform thickness; and a polymer sheet having a third surface, a fourth surface opposite the third surface, a plurality of apertures extending through the polymer sheet from the third surface to the fourth surface, a lattice structure having a plurality of intersecting rows that define the plurality of apertures, a continuous top perimeter edge opposite a continuous bottom perimeter edge, wherein the plurality of intersecting rows extend from the continuous top perimeter edge to the continuous bottom perimeter edge, wherein the polymer sheet is made of a single polymer material, wherein the polymer sheet is thermally bonded across the entire third surface to the first planar surface of the textile element such that each row of the plurality of intersecting rows of the lattice structure is melted to adhere to the first planar surface of the textile element, forming an overlay that covers a portion of the first planar surface of the textile element, the polymer sheet having a first side opposite a second side, the continuous top perimeter edge extends from the first side to the second side, the bottom continuous perimeter edge extends from the first side to a midpoint and onto the second side, the continuous bottom perimeter edge diverging from the continuous top perimeter edge from the first side to the midpoint and converging with the continuous top perimeter edge from the midpoint to the second side, wherein the midpoint is centered on a back of the article of apparel, wherein the bottom continuous perimeter edge transitions from diverging to converging only at the midpoint, wherein the continuous top perimeter edge extends in the shape of a smooth curve.

8. The waistband of claim 7, wherein at least a portion of the plurality of apertures comprise a rhomboid shape of a common size.

9. The waistband of claim 7, wherein the plurality of apertures includes apertures having a plurality of sizes.

10. The waistband of claim 7, wherein the polymer sheet is inelastic.

* * * * *